US007222670B2

(12) United States Patent
Zupanick

(10) Patent No.: US 7,222,670 B2
(45) Date of Patent: May 29, 2007

(54) SYSTEM AND METHOD FOR MULTIPLE WELLS FROM A COMMON SURFACE LOCATION

(75) Inventor: Joseph A. Zupanick, Pineville, WV (US)

(73) Assignee: CDX Gas, LLC, Dallas, TX (US)

( * ) Notice: Subject to any disclaimer, the term of this patent is extended or adjusted under 35 U.S.C. 154(b) by 116 days.

(21) Appl. No.: 10/788,694

(22) Filed: Feb. 27, 2004

(65) Prior Publication Data

US 2005/0189114 A1 Sep. 1, 2005

(51) Int. Cl.
*E21B 43/30* (2006.01)

(52) U.S. Cl. ..... 166/245; 166/50; 175/61

(58) Field of Classification Search ..... 168/245, 168/52, 50, 313, 369; 175/61, 62; 166/245, 166/52, 50, 313, 369
See application file for complete search history.

(56) References Cited

U.S. PATENT DOCUMENTS

| | | | |
|---|---|---|---|
| 54,144 | A | 4/1866 | Hamar |
| 274,740 | A | 3/1883 | Douglass |
| 526,708 | A | 10/1894 | Horton |
| 639,036 | A | 12/1899 | Heald |
| 1,189,560 | A | 7/1916 | Gondos |
| 1,285,347 | A | 11/1918 | Otto |
| 1,467,480 | A | 9/1923 | Hogue |
| 1,485,615 | A | 3/1924 | Jones |
| 1,488,106 | A | 3/1924 | Fitzpatrick |
| 1,520,737 | A | 12/1924 | Wright |
| 1,674,392 | A | 6/1928 | Flansburg |
| 1,777,961 | A | 10/1930 | Capeliuschnicoff |
| 2,018,285 | A | 10/1935 | Schweitzer et al. |
| 2,069,482 | A | 2/1937 | Seay |
| 2,150,228 | A | 3/1939 | Lamb |
| 2,169,718 | A | 8/1939 | Böll et al. |
| 2,335,085 | A | 11/1943 | Roberts |
| 2,450,223 | A | 9/1948 | Barbour |

(Continued)

FOREIGN PATENT DOCUMENTS

AU 85/49964 A 11/1986

(Continued)

OTHER PUBLICATIONS

Dreiling, Tim, McClelland, M.L. and Bilyeu, Brad, "Horizontal & High Angle Air Drilling in the San Juan Basin, New Mexico," Believed to be dated Apr. 1996, pp. 1-11.

(Continued)

*Primary Examiner*—David Bagnell
*Assistant Examiner*—Daniel P Stephenson
(74) *Attorney, Agent, or Firm*—Fish & Richardson P.C.

(57) ABSTRACT

A system for accessing a subterranean zone from an entry well including an entry well extending from the surface. The entry well has a substantially vertical portion. A one or more drainage wells extend from the entry well to a subterranean zone. A one or more articulated wells extend from the entry well to the subterranean zone. At least one of the articulated wells intersects at least one of the one or more drainage wells at a junction proximate the subterranean zone. A drainage pattern is formed coupled to the junction and operable to conduct fluids from the subterranean zone to the junction.

22 Claims, 5 Drawing Sheets

U.S. PATENT DOCUMENTS

| | | | |
|---|---|---|---|
| 2,490,350 | A | 12/1949 | Grable |
| 2,679,903 | A | 6/1954 | McGowen, Jr. et al. |
| 2,726,063 | A | 12/1955 | Ragland et al. |
| 2,726,847 | A | 12/1955 | McCune et al. |
| 2,783,018 | A | 2/1957 | Lytel |
| 2,797,893 | A | 7/1957 | McCune et al. |
| 2,847,189 | A | 8/1958 | Shook |
| 2,911,008 | A | 11/1959 | Du Bois |
| 2,934,904 | A | 5/1960 | Hendrix |
| 2,980,142 | A | 4/1961 | Turak |
| 3,163,211 | A | 12/1964 | Henley |
| 3,208,537 | A | 9/1965 | Scarborough |
| 3,347,595 | A | 10/1967 | Dahms et al. |
| 3,385,382 | A | 5/1968 | Canalizo et al. |
| 3,443,648 | A | 5/1969 | Howard |
| 3,473,571 | A | 10/1969 | Dugay |
| 3,503,377 | A | 3/1970 | Beatenbough et al. |
| 3,528,516 | A | 9/1970 | Brown |
| 3,530,675 | A | 9/1970 | Turzillo |
| 3,534,822 | A | 10/1970 | Campbell et al. |
| 3,578,077 | A | 5/1971 | Glenn, Jr. et al. |
| 3,582,138 | A | 6/1971 | Loofbourow et al. |
| 3,587,743 | A | 6/1971 | Howard |
| 3,684,041 | A | 8/1972 | Kammerer, Jr. et al. |
| 3,687,204 | A | 8/1972 | Marshall et al. |
| 3,692,041 | A | 9/1972 | Bondi |
| 3,744,565 | A | 7/1973 | Brown |
| 3,757,876 | A | 9/1973 | Pereau |
| 3,757,877 | A | 9/1973 | Leathers |
| 3,759,328 | A | 9/1973 | Ueber et al. |
| 3,763,652 | A | 10/1973 | Rinta |
| 3,800,830 | A | 4/1974 | Etter |
| 3,809,519 | A | 5/1974 | Garner |
| 3,825,081 | A | 7/1974 | McMahon |
| 3,828,867 | A | 8/1974 | Elwood |
| 3,874,413 | A | 4/1975 | Valdez |
| 3,887,008 | A | 6/1975 | Canfield |
| 3,902,322 | A | 9/1975 | Watanabe |
| 3,907,045 | A | 9/1975 | Dahl et al. |
| 3,934,649 | A | 1/1976 | Pasini, III et al. |
| 3,957,082 | A | 5/1976 | Fuson et al. |
| 3,961,824 | A | 6/1976 | Van Eek et al. |
| 4,011,890 | A | 3/1977 | Andersson |
| 4,020,901 | A | 5/1977 | Pisio et al. |
| 4,022,279 | A | 5/1977 | Driver |
| 4,030,310 | A | 6/1977 | Schirtzinger |
| 4,037,658 | A | 7/1977 | Anderson |
| 4,060,130 | A | 11/1977 | Hart |
| 4,073,351 | A | 2/1978 | Baum |
| 4,089,374 | A | 5/1978 | Terry |
| 4,116,012 | A | 9/1978 | Abe et al. |
| 4,134,463 | A | 1/1979 | Allen |
| 4,136,996 | A | 1/1979 | Burns |
| 4,151,880 | A | 5/1979 | Vann |
| 4,156,437 | A | 5/1979 | Chivens et al. |
| 4,169,510 | A | 10/1979 | Meigs |
| 4,182,423 | A | 1/1980 | Ziebarth et al. |
| 4,189,184 | A | 2/1980 | Green |
| 4,220,203 | A | 9/1980 | Steeman |
| 4,221,433 | A | 9/1980 | Jacoby |
| 4,222,611 | A | 9/1980 | Larson et al. |
| 4,224,989 | A | 9/1980 | Blount |
| 4,226,475 | A | 10/1980 | Frosch et al. |
| 4,257,650 | A | 3/1981 | Allen |
| 4,278,137 | A | 7/1981 | Van Eek |
| 4,283,088 | A | 8/1981 | Tabakov et al. |
| 4,296,785 | A | 10/1981 | Vitello et al. |
| 4,296,969 | A | 10/1981 | Willman |
| 4,299,295 | A | 11/1981 | Gossard |
| 4,303,127 | A | 12/1981 | Freel et al. |
| 4,305,464 | A | 12/1981 | Masszi |
| 4,312,377 | A | 1/1982 | Knecht |
| 4,317,492 | A | 3/1982 | Summers et al. |
| 4,328,577 | A | 5/1982 | Abbott et al. |
| 4,333,539 | A | 6/1982 | Lyons et al. |
| 4,356,866 | A | 11/1982 | Savins |
| 4,366,988 | A | 1/1983 | Bodine |
| 4,372,398 | A | 2/1983 | Kuckes |
| 4,386,665 | A | 6/1983 | Dellinger |
| 4,390,067 | A | 6/1983 | Willman |
| 4,396,075 | A | 8/1983 | Wood et al. |
| 4,396,076 | A | 8/1983 | Inoue |
| 4,397,360 | A | 8/1983 | Schmidt |
| 4,401,171 | A | 8/1983 | Fuchs |
| 4,407,376 | A | 10/1983 | Inoue |
| 4,415,205 | A | 11/1983 | Rehm et al. |
| 4,417,829 | A | 11/1983 | Berezoutzky |
| 4,422,505 | A | 12/1983 | Collins |
| 4,437,706 | A | 3/1984 | Johnson |
| 4,442,896 | A | 4/1984 | Reale et al. |
| 4,463,988 | A | 8/1984 | Bouck et al. |
| 4,494,616 | A | 1/1985 | McKee |
| 4,502,733 | A | 3/1985 | Grubb |
| 4,512,422 | A | 4/1985 | Knisley |
| 4,519,463 | A | 5/1985 | Schuh |
| 4,527,639 | A | 7/1985 | Dickinson, III et al. |
| 4,532,986 | A | 8/1985 | Mims et al. |
| 4,533,182 | A | 8/1985 | Richards |
| 4,536,035 | A | 8/1985 | Huffman et al. |
| 4,544,037 | A | 10/1985 | Terry |
| 4,558,744 | A | 12/1985 | Gibb |
| 4,565,252 | A | 1/1986 | Campbell et al. |
| 4,573,541 | A | 3/1986 | Josse et al. |
| 4,600,061 | A | 7/1986 | Richards |
| 4,603,592 | A | 8/1986 | Siebold et al. |
| 4,605,076 | A | 8/1986 | Goodhart |
| 4,611,855 | A | 9/1986 | Richards |
| 4,618,009 | A | 10/1986 | Carter et al. |
| 4,638,949 | A | 1/1987 | Mancel |
| 4,646,836 | A | 3/1987 | Goodhart |
| 4,651,836 | A | 3/1987 | Richards |
| 4,662,440 | A | 5/1987 | Harmon et al. |
| 4,674,579 | A | 6/1987 | Geller et al. |
| 4,676,313 | A | 6/1987 | Rinaldi |
| 4,702,314 | A | 10/1987 | Huang et al. |
| 4,705,109 | A | 11/1987 | Ledent et al. |
| 4,705,431 | A | 11/1987 | Gadelle et al. |
| 4,715,440 | A | 12/1987 | Boxell et al. |
| 4,718,485 | A | 1/1988 | Brown et al. |
| RE32,623 | E | 3/1988 | Marshall et al. |
| 4,727,937 | A | 3/1988 | Shum et al. |
| 4,753,485 | A | 6/1988 | Goodhart |
| 4,754,808 | A | 7/1988 | Harmon et al. |
| 4,754,819 | A | 7/1988 | Dellinger |
| 4,756,367 | A | 7/1988 | Puri et al. |
| 4,763,734 | A | 8/1988 | Dickinson et al. |
| 4,773,488 | A | 9/1988 | Bell et al. |
| 4,776,638 | A | 10/1988 | Hahn |
| 4,830,105 | A | 5/1989 | Petermann |
| 4,832,122 | A | 5/1989 | Corey et al. |
| 4,836,611 | A | 6/1989 | El-Saie |
| 4,842,081 | A | 6/1989 | Parant |
| 4,844,182 | A | 7/1989 | Tolle |
| 4,852,666 | A | 8/1989 | Brunet et al. |
| 4,883,122 | A | 11/1989 | Puri et al. |
| 4,889,186 | A | 12/1989 | Hanson et al. |
| 4,978,172 | A | 12/1990 | Schwoebel et al. |
| 5,016,709 | A | 5/1991 | Combe et al. |
| 5,016,710 | A | 5/1991 | Renard et al. |
| 5,033,550 | A | 7/1991 | Johnson et al. |
| 5,035,605 | A | 7/1991 | Dinerman et al. |
| 5,036,921 | A | 8/1991 | Pittard et al. |
| 5,074,360 | A | 12/1991 | Guinn |
| 5,074,365 | A | 12/1991 | Kuckes |

5,074,366 A 12/1991 Karlsson et al.
5,082,054 A 1/1992 Kiamanesh
5,111,893 A 5/1992 Kvello-Aune
5,115,872 A 5/1992 Brunet et al.
5,127,457 A 7/1992 Stewart et al.
5,135,058 A 8/1992 Millgard et al.
5,148,875 A 9/1992 Karlsson et al.
5,148,877 A 9/1992 MacGregor
5,165,491 A 11/1992 Wilson
5,168,942 A 12/1992 Wydrinski
5,174,374 A 12/1992 Hailey
5,193,620 A 3/1993 Braddick
5,194,859 A 3/1993 Warren
5,197,553 A 3/1993 Leturno
5,197,783 A 3/1993 Theimer et al.
5,199,496 A 4/1993 Redus et al.
5,201,817 A 4/1993 Hailey
5,207,271 A 5/1993 Sanchez et al.
5,217,076 A 6/1993 Masek
5,226,495 A 7/1993 Jennings, Jr.
5,240,350 A 8/1993 Yamaguchi et al.
5,242,017 A 9/1993 Hailey
5,242,025 A 9/1993 Neill et al.
5,246,273 A 9/1993 Rosar
5,255,741 A 10/1993 Alexander
5,271,472 A 12/1993 Leturno
5,287,926 A 2/1994 Grupping
5,289,888 A 3/1994 Talley
5,301,760 A 4/1994 Graham
5,343,965 A 9/1994 Talley et al.
5,355,967 A 10/1994 Mueller et al.
5,363,927 A 11/1994 Frank
5,385,205 A 1/1995 Hailey
5,394,950 A 3/1995 Gardes
5,402,851 A 4/1995 Baiton
5,411,082 A 5/1995 Kennedy
5,411,085 A 5/1995 Moore et al.
5,411,088 A 5/1995 LeBlanc et al.
5,411,104 A 5/1995 Stanley
5,411,105 A 5/1995 Gray
5,431,220 A 7/1995 Lennon et al.
5,431,482 A 7/1995 Russo
5,435,400 A 7/1995 Smith
5,447,416 A 9/1995 Wittrisch
5,450,902 A 9/1995 Matthews
5,454,419 A 10/1995 Vloedman
5,458,209 A 10/1995 Hayes et al.
5,462,116 A 10/1995 Carroll
5,462,120 A 10/1995 Gondouin
5,469,155 A 11/1995 Archambeault et al.
5,477,923 A 12/1995 Jordan, Jr. et al.
5,485,089 A 1/1996 Kuckes
5,494,121 A 2/1996 Nackerud
5,499,687 A 3/1996 Lee
5,501,273 A 3/1996 Puri
5,501,279 A 3/1996 Garg et al.
5,520,252 A 5/1996 McNair
5,584,605 A 12/1996 Beard et al.
5,613,242 A 3/1997 Oddo
5,615,739 A 4/1997 Dallas
5,653,286 A 8/1997 McCoy et al.
5,664,911 A 9/1997 Bridges et al.
5,669,444 A 9/1997 Riese et al.
5,676,207 A 10/1997 Simon et al.
5,680,901 A 10/1997 Gardes
5,690,390 A 11/1997 Bithell
5,697,445 A 12/1997 Graham
5,706,871 A 1/1998 Andersson et al.
5,720,356 A 2/1998 Gardes
5,727,629 A 3/1998 Blizzard, Jr. et al.
5,733,067 A 3/1998 Hunt et al.
5,735,350 A 4/1998 Longbottom et al.
5,771,976 A 6/1998 Talley
5,775,433 A 7/1998 Hammett et al.
5,775,443 A 7/1998 Lott
5,785,133 A 7/1998 Murray et al.
5,832,958 A 11/1998 Cheng
5,853,054 A 12/1998 McGarian et al.
5,853,056 A 12/1998 Landers
5,853,224 A 12/1998 Riese
5,863,283 A 1/1999 Gardes
5,868,202 A 2/1999 Hsu
5,868,210 A 2/1999 Johnson et al.
5,879,057 A 3/1999 Schwoebel et al.
5,884,704 A 3/1999 Longbottom et al.
5,917,325 A 6/1999 Smith
5,934,390 A 8/1999 Uthe
5,938,004 A 8/1999 Roberts et al.
5,941,307 A 8/1999 Tubel
5,941,308 A 8/1999 Malone et al.
5,944,107 A 8/1999 Ohmer
5,957,539 A 9/1999 Durup et al.
5,971,074 A 10/1999 Longbottom et al.
5,988,278 A 11/1999 Johnson
5,992,524 A 11/1999 Graham
6,012,520 A 1/2000 Yu et al.
6,015,012 A 1/2000 Reddick
6,019,173 A 2/2000 Saurer et al.
6,024,171 A 2/2000 Montgomery et al.
6,030,048 A 2/2000 Hsu
6,050,335 A 4/2000 Parsons
6,056,059 A 5/2000 Ohmer
6,062,306 A 5/2000 Gano et al.
6,065,550 A 5/2000 Gardes
6,065,551 A 5/2000 Gourley et al.
6,079,495 A 6/2000 Ohmer
6,089,322 A 7/2000 Kelley et al.
6,119,771 A 9/2000 Gano et al.
6,119,776 A 9/2000 Graham et al.
6,135,208 A 10/2000 Gano et al.
6,170,571 B1 1/2001 Ohmer
6,179,054 B1 1/2001 Stewart
6,189,616 B1 2/2001 Gano et al.
6,192,988 B1 2/2001 Tubel
6,199,633 B1 3/2001 Longbottom
6,209,636 B1 4/2001 Roberts et al.
6,237,284 B1 5/2001 Erickson
6,244,340 B1 6/2001 McGlothen et al.
6,247,532 B1 6/2001 Ohmer
6,263,965 B1 7/2001 Schmidt et al.
6,279,658 B1 8/2001 Donovan et al.
6,280,000 B1 8/2001 Zupanick
6,283,216 B1 9/2001 Ohmer
6,318,457 B1 11/2001 Den Boer et al.
6,349,769 B1 2/2002 Ohmer
6,357,523 B1 3/2002 Zupanick
6,357,530 B1 3/2002 Kennedy et al.
6,425,448 B1 7/2002 Zupanick et al.
6,439,320 B2 8/2002 Zupanick
6,450,256 B2 9/2002 Mones
6,454,000 B1 9/2002 Zupanick
6,457,525 B1 10/2002 Scott
6,457,540 B2 10/2002 Gardes
6,470,978 B2 10/2002 Trueman et al.
6,478,085 B2 11/2002 Zupanick
6,491,101 B2 12/2002 Ohmer
6,497,556 B2 12/2002 Zupanick et al.
6,554,063 B2 4/2003 Ohmer
6,557,628 B2 5/2003 Ohmer
6,561,277 B2 5/2003 Algeory et al.
6,561,288 B2 5/2003 Zupanick
6,564,867 B2 5/2003 Ohmer
6,566,649 B1 5/2003 Mickael
6,571,888 B2 6/2003 Comeau et al.
6,575,235 B2 6/2003 Zupanick et al.
6,575,255 B1 6/2003 Rial et al.

| | | | |
|---|---|---|---|
| 6,577,129 | B1 | 6/2003 | Thompson et al. |
| 6,581,455 | B1 | 6/2003 | Berger et al. |
| 6,581,685 | B2 | 6/2003 | Burgess et al. |
| 6,585,061 | B2 | 7/2003 | Radzinski et al. |
| 6,590,202 | B2 | 7/2003 | Mickael |
| 6,591,903 | B2 | 7/2003 | Ingle et al. |
| 6,591,922 | B1 | 7/2003 | Rial et al. |
| 6,595,301 | B1 | 7/2003 | Diamond et al. |
| 6,595,302 | B1 | 7/2003 | Diamond et al. |
| 6,598,686 | B1 | 7/2003 | Zupanick |
| 6,604,580 | B2 | 8/2003 | Zupanick et al. |
| 6,604,910 | B1 | 8/2003 | Zupanick |
| 6,607,042 | B2 | 8/2003 | Hoyer et al. |
| 6,636,159 | B1 | 10/2003 | Winnacker |
| 6,639,210 | B2 | 10/2003 | Odom et al. |
| 6,644,422 | B1 | 11/2003 | Rial et al. |
| 6,646,441 | B2 | 11/2003 | Thompson et al. |
| 6,653,839 | B2 | 11/2003 | Yuratich et al. |
| 6,662,870 | B1 | 12/2003 | Zupanick et al. |
| 6,668,918 | B2 | 12/2003 | Zupanick |
| 6,679,322 | B1 | 1/2004 | Zupanick |
| 6,681,855 | B2 | 1/2004 | Zupanick et al. |
| 6,688,388 | B2 | 2/2004 | Zupanick |
| 6,708,764 | B2 | 3/2004 | Zupanick |
| 6,722,452 | B1 | 4/2004 | Rial et al. |
| 6,725,922 | B2 | 4/2004 | Zupanick |
| 6,732,792 | B2 | 5/2004 | Zupanick |
| 6,745,855 | B2 | 6/2004 | Gardes |
| 6,758,279 | B2 | 7/2004 | Moore et al. |
| 6,758,289 | B2 | 7/2004 | Kelley et al. |
| RE38,642 | E | 11/2004 | Gondouin |
| 2002/0043404 | A1 | 4/2002 | Trueman et al. |
| 2002/0096336 | A1 | 7/2002 | Zupanick et al. |
| 2002/0189801 | A1 | 12/2002 | Zupanick et al. |
| 2003/0066686 | A1 | 4/2003 | Conn |
| 2003/0075334 | A1 | 4/2003 | Haugen et al. |
| 2003/0164253 | A1 | 9/2003 | Trueman et al. |
| 2003/0217842 | A1 | 11/2003 | Zupanick et al. |
| 2003/0221836 | A1 | 12/2003 | Gardes |
| 2003/0234120 | A1 | 12/2003 | Paluch et al. |
| 2004/0007389 | A1 | 1/2004 | Zupanick |
| 2004/0007390 | A1 | 1/2004 | Zupanick |
| 2004/0011560 | A1 | 1/2004 | Rial et al. |
| 2004/0020655 | A1 | 2/2004 | Rusby et al. |
| 2004/0031609 | A1 | 2/2004 | Zupanick |
| 2004/0033557 | A1 | 2/2004 | Scott et al. |
| 2004/0035582 | A1 | 2/2004 | Zupanick |
| 2004/0050552 | A1 | 3/2004 | Zupanick |
| 2004/0050554 | A1 | 3/2004 | Zupanick et al. |
| 2004/0055787 | A1 | 3/2004 | Zupanick |
| 2004/0060351 | A1 | 4/2004 | Gunter et al. |
| 2004/0140129 | A1 | 7/2004 | Gardes |
| 2004/0226719 | A1 | 11/2004 | Morgan et al. |
| 2005/0133219 | A1 | 6/2005 | Zupanick |
| 2005/0252689 | A1 | 11/2005 | Gardes |
| 2005/0257962 | A1 | 11/2005 | Zupanick |
| 2006/0096755 | A1 | 5/2006 | Zupanic |

FOREIGN PATENT DOCUMENTS

| | | | |
|---|---|---|---|
| CA | 2210866 | | 1/1998 |
| CA | 2278735 | | 8/1998 |
| CH | 653741 | A5 | 1/1986 |
| DE | 197 25 996 | A1 | 1/1998 |
| EP | 0 819 834 | A1 | 1/1998 |
| EP | 0 875 661 | A1 | 11/1998 |
| EP | 0 952 300 | A1 | 10/1999 |
| EP | 1 316 673 | A2 | 6/2003 |
| FR | 964503 | | 8/1950 |
| GB | 442008 | | 1/1936 |
| GB | 444484 | | 3/1936 |
| GB | 651468 | | 4/1951 |
| GB | 893869 | | 4/1962 |
| GB | 2 225 033 | A | 10/1992 |
| GB | 2 297 988 | A | 8/1996 |
| GB | 2 347 157 | A | 8/2000 |
| SU | 750108 | | 6/1975 |
| SU | 876968 | | 10/1981 |
| SU | 1448078 | A1 | 3/1987 |
| SU | 1770570 | A1 | 3/1990 |
| UA | 37720 | A | 5/2001 |
| WO | WO 94/21889 | | 9/1994 |
| WO | WO 94/28280 | | 12/1994 |
| WO | WO 97/21900 | | 6/1997 |
| WO | WO 98/25005 | | 6/1998 |
| WO | WO 98/35133 | | 8/1998 |
| WO | WO 99/60248 | | 11/1999 |
| WO | WO 00/31376 | | 6/2000 |
| WO | WO 00/79099 | A1 | 12/2000 |
| WO | WO 01/44620 | A1 | 6/2001 |
| WO | WO 02/18738 | A1 | 3/2002 |
| WO | WO 02/059455 | A1 | 8/2002 |
| WO | WO 02/061238 | A1 | 8/2002 |
| WO | WO 03/036023 | A1 | 5/2003 |
| WO | WO 03/038233 | A1 | 5/2003 |
| WO | WO 03/102348 | A2 | 12/2003 |
| WO | WO 2004035984 | A1 | 4/2004 |
| WO | WO 2005/003509 | A1 | 1/2005 |
| WO | WO 2005/012688 | A1 | 2/2005 |

OTHER PUBLICATIONS

Technology Scene Drilling & Intervention Services, "Weatherford Moves Into Advanced Multilateral Well Completion Technology" and "Productivity Gains and Safety Record Speed Acceptance of UBS," *Reservoir Mechanics*, Weatherford International, Inc., 2000 Annual Report (2 pages).

Bahr, Angie, "Methane Draining Technology Boosts Safety and Energy Production," Energy Review, Feb. 4, 2005, Website: www.energyreview.net/storyviewprint.asp, printed Feb. 7, 2005 (2 pages).

Molvar, Erik M., "Drilling Smarter: Using Directional Drilling to Reduce Oil and Gas Impacts in the Intermountain West," Prepared by Biodiversity Conservation Alliance, Report issued Feb. 18, 2003, 34 pages.

King, Robert F., "Drilling Sideways—A Review of Horizontal Well Technology and Its Domestic Application," DOE/EIA-TR-0565, U.S. Department of Energy, Apr. 1993, 30 pages.

Santos, Helio, SPE, Impact Engineering Solutions and Jesus Olaya, Ecopetrol/ICP, "*No-Damage Drilling: How to Achieve this Challenging Goal?*," SPE 77189, Copyright 2002, presented at the IADC/SPE Asia Pacific Drilling Technology, Jakarta, Indonesia, Sep. 9-Nov. 2002, 10 pages.

Santos, Helio, SPE, Impact Engineering Solutions, "*Increasing Leakoff Pressure with New Class of Drilling Fluid*," SPE 78243, Copyright 2002, presented at the SPE/ISRM Rock Mechanics Conference in Irving, Texas, Oct. 20-23, 2002, 7 pages.

Franck Labenski, Paul Reid, SPE, and Helio Santos, SPE, Impact Solutions Group, "*Drilling Fluids Approaches for Control of Wellbore Instability in Fractured Formations*," SPE/IADC 85304, Society of Petroleum Engineers, Copyright 2003, presented at the SPE/IADC Middle East Drilling Technology Conference & Exhibition in Abu Chabi, UAE, Oct. 20-22, 2003, 8 pages.

P. Reid, SPE, and H. Santos, SPE, Impact Solutions Group, "*Novel Drilling, Completion and Workover Fluids for Depleted Zones: Avoiding Losses, Formation Damage and Stuck Pipe*," SPE/IADC 85326, Society of Petroleum Engineers, Copyright 2003, presented at the SPE/IADC Middle East Drilling Conference & Exhibition in Abu Chabi, UAE, Oct. 20-22, 2003, 9 pages.

Craig C. White and Adrian P. Chesters, NAM; Catalin D. Ivan, Sven Maikranz and Rob Nouris, M-I L.L.C., "*Aphron-based drilling fluid: Novel technology for drilling depleted formations*," World Oil, Drilling Report Special Focus, Oct. 2003, 5 pages.

Robert E. Snyder, "Drilling Advances," World Oil, Oct. 2003, 1 page.

U.S. Environmental Protection Agency, "Directional Drilling Technology," prepared for the EPA by Advanced Resources International under Contract 68-W-00-094, Coalbed Methane Outreach Program (CMOP), Website: http://search.epa.gov/s97is.vts, printed Mar. 17, 2005, 13 pages.
"Meridian Tests New Technology," Western Oil World, Jun. 1990, Cover, Table of Contents and p. 13.
Clint Leazer and Michael R. Marquez, "Short-Radius Drilling Expands Horizontal Well Applications," Petroleum Engineer International, Apr. 1995, 6 pages.
Terry R. Logan, "Horizontal Drainhole Drilling Techniques Used in Rocky Mountains Coal Seams," Geology and Coal-Bed Methane Resources of the Northern San Juan Basin, Colorado and New Mexico, Rocky Mountain Association of Geologists, Coal-Bed Methane, San Juan Basin, 1988, pp. cover, 133-142.
Daniel J. Brunner, Jeffrey J. Schwoebel, and Scott Thomson, "Directional Drilling for Methane Drainage & Exploration in Advance of Mining," Website: http://www.advminingtech.com.au/Paper4.htm, printed Apr. 6, 2005, Copyright 1999, Last modified Aug. 7, 2002 (8 pages).
Karen Bybee, highlights of paper SPE 84424, "Coalbed-Methane Reservoir Simulation: An Evolving Science," by T.L. Hower, JPT Online, Apr. 2004, Website: http://www.spe.org/spe/jpt/jsp/jptpapersynopsis/0,2439,1104_11038_2354946_2395832,00.html, printed Apr. 14, 2005, 4 pages.
Kevin Meaney and Lincoln Paterson, "Relative Permeability in Coal," SPE 36986, Society of Petroleum Engineers, Copyright 1996, pp. 231-236.
Calendar of Events—Conference Agenda, Fifth Annual Unconventional Gas and Coalbed Methane Conference, Oct. 22-24, 2003, in Calgary Alberta, Website: http://www.csug.ca/cal/calc0301a.html, printed Mar. 17, 2005, 5 pages.
Tom Engler and Kent Perry, "Creating a Roadmap for Unconventional Gas R&D," Gas TIPS, Fall 2002, pp. 16-20.
CSIRO Petroleum—SIMEDWin, "Summary of SIMEDWin Capabilities," Copyright 1997-2005, Website: http://www.dpr.csiro.au/ourcapabilities/petroleumgeoengineering/reservoirengineering/projects/simedwin/assets/simed/index.html, printed Mar. 17, 2005, 10 pages.
Solutions From the Field, "Coalbed Methane Resources in the Southeast," Copyright 2004, Website: http://www.pttc.org/solutions/sol_2004/537.htm, printed Mar. 17, 2005, 7 pages.
Jeffrey R. Levine, Ph.D., "Matrix Shrinkage Coefficient," Undated, 3 pages.
G. Twombly, S.H. Stepanek, T.A. Moore, Coalbed Methane Potential in the Waikato Coalfield of New Zealand: A Comparison With Developed Basins in the United States, 2004 New Zealand Petroleum Conference Proceedings, Mar. 7-10, 2004, pp. 1-6.
R.W. Cade, "Horizontal Wells: Development and Applications," Presented at the Fifth International Symposium on Geophysics for Mineral, Geotechnical and Environmental Applications, Oct. 24-28, 1993 in Tulsa, Oklahoma, Website: http://www.mgls.org/93Sym/Cade/cade.html, printed Mar. 17, 2005, 6 pages.
Solutions From the Field, "Horizontal Drilling, A Technology Update for the Appalachian Basin," Copyright 2004, Website: http://www.pttc.org/solutions/sol_2004/535.htm, printed Mar. 17, 2005, 6 pages.
R. Purl, J.C. Evanoff and M.L. Brugler, "Measurement of Coal Cleat Porosity and Relative Permeability Characteristics," SPE 21491, Society of Petroleum Engineers, Copyright 1991, pp. 93-104.
Peter Jackson, "Drilling Technologies for Underground Coal Gasification," IMC Geophysics Ltd., International UCG Workshop—Oct. 2003 (20 pages).
Notification of Transmittal of the International Search Report and the Written Opinion of the International Searching Authority, or the Declaration (3 pages), International Search Report (3 pages) and Written Opinion of the International Searching Authority (5 pages) re International Application No. PCT/US2005/002162 mailed Apr. 22, 2005.
Notification of Transmittal of the International Search Report and the Written Opinion of the International Searching Authority, or the Declaration (3 pages), International Search Report (3 pages) and Written Opinion of the International Searching Authority (5 pages) re International Application No. PCT/US2005/005289 mailed Apr. 29, 2005.
Notification of Transmittal of the International Search Report and the Written Opinion of the International Searching Authority, or the Declaration (3 pages), International Search Report (5 pages) and Written Opinion of the International Searching Authority (5 pages) re International Application No. PCT/US2004/036616 mailed Feb. 24, 2005.
Notification of Transmittal of the International Preliminary Examination Report (1 page) and International Preliminary Examination Report (3 pages) for International Application No. PCT/US03/13954 mailed Apr. 14, 2005.
Notification of Transmittal of the International Preliminary Examination Report (1 page) and International Preliminary Examination Report (5 pages) mailed Jan. 18, 2005 and Written Opinion (8 pages) mailed Aug. 25, 2005 for International Application No. PCT/US03/30126.
Notification of Transmittal of the International Search Report or the Declaration (3 pages) and International Search Report (5 pages) mailed Nov. 10, 2000 for International Application No. PCT/US99/27494.
Notification of Transmittal of the International Preliminary Examination Report (1 page) and International Preliminary Examination Report (6 pages) mailed Apr. 2, 2001 and Written Opinion mailed Sep. 27, 2000 for International Application No. PCT/US99/27494.
Notification of Transmittal of the International Search Report or the Declaration (3 pages) and International Search Report (5 pages) mailed Jun. 6, 2002 for International Application No. PCT/US02/02051.
Notification of Transmittal of the International Search Report or the Declaration (3 pages) and International Search Report (6 pages) mailed Mar. 13, 2003 for International Application No. PCT/US02/33128.
Notification of Transmittal of the International Preliminary Examination Report (1 page) and International Preliminary Examination Report (3 pages) mailed Apr. 22, 2004 and Written Opinion mailed Sep. 4, 2003 for International Application No. PCT/US02/33128.
Listing of 174 References received from Third Party on Feb. 16, 2005 (9 pages).
Gardes Directional Drilling, "Multiple Directional Wells From Single Borehole Developed," Reprinted from Jul. 1989 edition of Offshore, Copyright 1989 by PennWell Publishing Company (4 pages).
"Economic Justification and Modeling of Multilateral Wells," Economic Analysis, Hart's Petroleum Engineer International, 1997 (4 pages).
Mike Chambers, "Multi-Lateral Completions at Mobil Past, Present, and Future," presented at the 1998 Summit on E&P Drilling Technologies, Strategic Research Institute, Aug. 18-19, 1998 in San Antonio, Texas (26 pages).
David C. Oyler and William P. Diamond, "Drilling a Horizontal Coalbed Methane Drainage System From a Directional Surface Borehole," PB82221516, National Technical Information Service, Bureau of Mines, Pittsburgh Research Center, Apr. 1982 (56 pages).
P. Corlay, D. Bossie-Codreanu, J.C. Sabathier and E.R. Delamaide, "Improving Reservoir Management With Complex Well Architectures," Field Production & Reservoir Management, World Oil, Jan. 1997 (5 pages).
Eric R. Skonberg and Hugh W. O'Donnell, "Horizontal Drilling for Underground Coal Gasification," presented at the Eighth Underground Coal Conversion Symposium, Keystone, Colorado, Aug. 16, 1982 (8 pages).
Gamal Ismail, A.S. Fada'q, S. Kikuchi, H. El Khatib, "Ten Years Experience in Horizontal Application & Pushing the Limits of Well Construction Approach in Upper Zakum Field (Offshore Abu Dhabi)," SPE 87284, Society of Petroleum Engineers, Oct. 2000 (17 pages).
Gamal Ismail, H. El-Khatib—ZADCO, Abu Dhabi, UAE, "Multi-Lateral Horizontal Drilling Problems & Solutions Experienced Offshore Abu Dhabi," SPE 36252, Society of Petroleum Engineers, Oct. 1996 (12 pages).

C.M. Matthews and L.J. Dunn, "Drilling and Production Practices to Mitigate Sucker Rod/Tubing Wear-Related Failures in Directional Wells," SPE 22852, Society of Petroleum Engineers, Oct. 1991 (12 pages).
H.H. Fields, Stephen Krickovic, Albert Sainato, and M.G. Zabetakis, "Degasification of Virgin Pittsburgh Coalbed Through a Large Borehole," RI-7800, Bureau of Mines Report of Investigations/1973, United States Department of the Interior, 1973 (31 pages).
William P. Diamond, "Methane Control for Underground Coal Mines," IC-9395, Bureau of Mines Information Circular, United States Department of the Interior, 1994 (51 pages).
Technology Scene Drilling & Intervention Services, "Weatherford Moves Into Advanced Multilateral Well Completion Technology," *Reservoir Mechanics*, Weatherford International, Inc., 2000 Annual Report (2 pages).
"A Different Direction for CBM Wells," *W Magazine*, 2004 Third Quarter (5 pages).
Snyder, Robert E., "What's New in Production,"*WorldOil Magazine*, Feb. 2005, [retrieved from the internet on Mar. 7, 2005], http://www.worldoil.com/magazine/MAGAZINE_DETAIL.asp?ART_ID=2507@MONTH_YEAR (3 pages).
Nazzal, Greg, "Moving Multilateral Systems to the Next Level," Strategic Acquistion Expands Weatherford's Capabilities, 2000 (2 pages).
Notification of Transmittal of the International Search Report and the Written Opinion of the International Searching Authority, or the Declaration (3 pages), International Search Report (3 pages), and Written Opinion of the International Searching Authority (5 pages) re International Application No. PCT/US2004/024518 mailed Nov. 10, 2004.
Schenk, Christopher J., "Geologic Definition and Resource Assessment of Continuous (Unconventional) Gas Accumulations—the U.S. Experience," Website, http://aapg.confex.com/...//, printed Nov. 16, 2004 (1 page).
U.S. Department of Interior, U.S. Geological Survey, "Characteristics of Discrete and Basin-Centered Parts of the Lower Silurian Regional Oil and Gas Accumulation, Appalachian Basin: Preliminary Results From a Data Set of 25 oil and Gas Fields," U.S. Geological Survey Open-file Report 98-216, Website, http://pubs.usgs.gov/of/1998/of98-216/introl.htm, printed Nov. 16, 2004 (2 pages).
Zupanick, J., "Coalbed Methane Extraction," 28th Mineral Law Conference, Lexington, Kentucky, Oct. 16-17, 2003 (48 pages).
Zupanick, J., "CDX Gas—Pinnacle Project," Presentation at the 2002 Fall Meeting of North American Coal Bed Methane Forum, Morgantown, West Virginia, Oct. 30, 2002 (23 pages).
Lukas, Andrew, Lucas Drilling Pty Ltd., "Technical Innovation and Engineering Xstrata—Oaky Creek Coal Pty Limited," Presentation at Coal Seam Gas & Mine Methane Conference in Brisbane, Nov. 22-23, 2004 (51 pages).
Field, Tony, Mitchell Drilling, "Let's Get Technical—Drilling Breakthroughs in Surface to In-Seam in Australia," Presentation at Coal Seam Gas & Mine Methane Conference in Brisbane, Nov. 22-23, 2004 (20 pages).
Zupanick, Joseph A, "Coal Mine Methane Drainage Utilizing Multilateral Horizontal Wells," 2005 SME Annual Meeting & Exhibit, Feb. 28-Mar. 2, 2005, Salt Lake City, Utah (6 pages).
The Official Newsletter of the Cooperative Research Centre for Mining Technology and Equipment, CMTE News 7, "Tight-Radius Drilling Clinches Award," Jun. 2001, 1 page.
PowerPoint Presentation entitled, "Horizontal Coalbed Methane Wells," by Bob Stayton, Computalog Drilling Services, date is believed to have been in 2002 (39 pages).
Denney, Dennis, "*Drilling Maximum-Reservoir-Contact Wells in the Shaybah Field*, " SPE 85307, pp. 60, 62-63, Oct. 20, 2003.
Notification of Transmittal of the International Search Report and the Written Opinion of the International Searching Authority, or the Declaration (3 pages), International Search Report (5 pages) and Written Opinion of the International Searching Authority (6 pages) re International Application No. PCT/US2004/012029 mailed Sep. 22, 2004.
Brunner, D.J. and Schwoebel, J.J., "Directional Drilling for Methane Drainage and Exploration in Advance in Mining," REI Drilling Directional Underground, World Coal, 1999, 10 pages.
Thakur, P.C., "A History of Coalbed Methane Drainage From United States Coal Mines," 2003 SME Annual Meeting, Feb. 24-26, Cincinnati, Ohio, 4 pages.
U.S. Climate Change Technology Program, "Technology Options for the Near and Long Term," 4.1.5 Advances in Coal Mine Methane Recovery Systems, pp. 162-164.
Notification of Transmittal of the International Search Report and the Written Opinion of the International Searching Authority, or the Declaration (3 pages), International Search Report (3 pages) and Written Opinion of the International Searching Authority (7 pages) re International Application No. PCT/US2004/017048 mailed Oct. 21, 2004.
Gardes, Robert, "Multi-Seam Completion Technology," Natural Gas Quarterly, E&P, Jun. 2004, pp. 78-81.
Baiton, Nicholas, "Maximize Oil Production and Recovery," Vertizontal Brochure, received Oct. 2, 2002, 4 pages.
Dreiling, Tim, McClelland, M.L. and Bilyeu, Brad, "Horizontal & High Angle Air Drilling in the San Juan Basin, New Mexico," Dated on or about Mar. 6, 2003, pp. 1-11.
Fong, David K., Wong, Frank Y., and McIntyre, Frank J., "An Unexpected Benefit of Horizontal Wells on Offset Vertical Well Productivity in Vertical Miscible Floods," Canadian SPE/CIM/CANMET Paper No. HWC94-09, paper to be presented Mar. 20-23, 1994, Calgary, Canada, 10 pages.
Fischer, Perry A., "What's Happening in Production," World Oil, Jun. 2001, p. 27.
Website of PTTC Network News vol. 7, 1st Quarter 2001, Table of Contents, http://www.pttc.org/../news/v7n1nn4.htm printed Apr. 25, 2003, 3 pages.
Cox, Richard J.W., "Testing Horizontal Wells While Drilling Underbalanced," Delft University of Technology, Aug. 1998, 68 pages.
McLennan, John, et al., "Underbalanced Drilling Manual," Gas Research Institute, Chicago, Illinois, GRI Reference No. GRI-97/0236, copyright 1997, 502 pages.
The Need for a Viable Multi-Seam Completion Technology for the Powder River Basin, Current Practice and Limitations, Gardes Energy Services, Inc., Believed to be 2003 (8 pages).
Langley, Diane, "Potential Impace of Microholes Is Far From Diminutive," JPT Online, http://www.spe.org/spe/jpt/jps, Nov. 2004 (5 pages).
Consol Energy Slides, "Generating Solutions, Fueling Change," Presented at Appalachian E&P Forum, Harris Nesbit Corp., Boston, Oct. 14, 2004 (29 pages).
McCray and Cole, "*Oil Well Drilling and Technology*," University of Oklahoma Press, 1959, pp. 315-319 (7 pages).
Berger and Anderson, "*Modern Petroleum: A Basic Primer of the Industry*," PennWell Books, 1978, pp. 106-108 (5 pages).
Jones, Arfon H., et al., "*A Review of the Physical and Mechanical Properties of Coal with Implications for Coal-Bed Methane Well Completion and Production*," Rocky Mountain Association of Geologists, 1988, pp. 169-181 (13 pages).
Hartman, Howard L., et al., "*SME Mining Engineering Handbook*;" Society for Mining, Metallurgy, and Exploration, Inc. 2nd Edition, vol. 2, 1992, Title Page, pp. 1946-1950 (6 pages).
Hassan, Dave, et al., "*Multi-Lateral Technique Lowers Drilling Costs, Provides Environmental Benefits*," Drilling Technology, Oct. 1999, pp. 41-47 (7 pages).
Ramaswamy, Gopal, "*Production History Provides CBM Insights*," Oil & Gas Journal, Apr. 2, 2001, pp. 49, 50 and 52 (32 pages).
Chi, Weiguo, et al., "*Feasibility of Coalbed Methane Exploitation in China*," Horizontal Well Technology, Sep. 2001, Title Page and p. 74 (2 pages).
Nackerud Product Description, Harvest Tool Company, LLC, Received Sep. 27, 2001, 1 page.
Ramaswamy, Gopal, "*Advances Key For Coalbed Methane*," The American Oil & Gas Reporter, Oct. 2001, Title Page and pp. 71 and 73 (3 pages).
Stevens, Joseph C., "*Horizontal Applications for Coal Bed Methane Recovery*," Strategic Research Institute, 3rd Annual Coalbed and Coal Mine Methane Conference, Slides, Mar. 25, 2002, Title Page, Introduction Page and pp. 1-10 (13 pages).
Stayton, R.J. "Bob", "*Horizontal Wells Boost CBM Recovery*," Special Report: Horizontal and Directional Drilling, The American Oil and Gas Reporter, Aug. 2002, pp. 71, 73-75 (4 pages).
Eaton, Susan, "*Reversal of Fortune: Vertical and Horizontal Well Hybrid Offers Longer Field Life*," New Technology Magazine, Sep. 2002, pp. 30-31 (2 pages).
Mahony, James, "*A Shadow of Things to Come*," New Technology Magazine, Sep. 2002, pp. 28-29 (2 pages).
Documents Received from Third Party, Great Lakes Directional Drilling, Inc., Sep. 12, 2002, (12 pages).
Taylor, Robert W., et al. "*Multilateral Technologies Increase Operational Efficiencies in Middle East*," Oil and Gas Journal, Mar. 16, 1998, pp. 76-80 (5 pages).
Pasiczynk, Adam, "*Evolution Simplifies Multilateral Wells*," Directional Drilling, Jun. 2000, pp. 53-55 (3 pages).
Bell, Steven S. "*Multilateral System with Full Re-Entry Access Installed*," World Oil, Jun. 1, 1996, p. 29 (1 page).
Jackson, P., et al., "*Reducing Long Term Methane Emissions Resulting from Coal Mining*," Energy Convers. Mgmt, vol. 37, Nos. 6-8, pp. 801-806, 1996 (6 pages).
Breant, Pascal, "*Des Puits Branches, Chez Total : les puits multi drains*," Total Exploration Production, Jan. 1999, 11 pages, including translation.
Chi, Weiguo, "*A feasible discussion on exploitation coalbed methane through Horizontal Network Drilling in China*," SPE 64709, Society of Petroleum Engineers (SPE International), Nov. 7, 2000, 4 pages.
B. Goktas et al., "*Performance of Openhole Completed and Cased Horizontal/Undulating Wells in Thin-Bedded, Tight Sand Gas Reservoirs*," SPE 65619, Society of Petroleum Engineers, Oct. 17-19, 2000 (7 pages).
Sharma, R., et al., "*Modelling of Undulating Wellbore Trajectories*," The Journal of Canadian Petroleum Technology, vol. 34, No. 10, XP-002261908, Oct. 18-20, 1993 pp. 16-24 (9 pages).
Balbinski, E.F., "*Prediction of Offshore Viscous Oil Field Performance*," European Symposium on Improved Oil Recovery, Aug. 18-20, 1999, pp. 1-10 (10 pages).
Notification of Transmittal of the International Search Report or the Declaration (PCT Rule 44.1) (3 pages) and International Search Report (7 pages) re International Application No. PCT/US 03/04771 mailed Jul. 4, 2003.
Notification of Transmittal of the International Search Report or the Declaration (PCT Rule 44.1) (3 pages) and International Search Report (4 pages) re International Application No. PCT/US 03/21626 mailed Nov. 6, 2003.
Notification of Transmittal of the International Search Report or the Declaration (PCT Rule 44.1) (3 pages) and International Search Report (5 pages) re International Application No. PCT/US 03/21891 mailed Nov. 13, 2003.
Notification of Transmittal of the International Search Report or the Declaration (PCT Rule 44.1) (3 pages) and International Search Report (4 pages) re International Application No. PCT/US 03/38383 mailed Jun. 2, 2004.
Notification of Transmittal of the International Search Report or the Declaration (PCT Rule 44.1) (3 pages) and International Search Report (5 pages) re International Application No. PCT/US 03/21627 mailed Nov. 5, 2003.
Notification of Transmittal of the International Search Report or the Declaration (PCT Rule 44.1) (3 pages) and International Search Report (4 pages) re International Application No. PCT/US 03/21628 mailed Nov. 4, 2003.
Notification of Transmittal of the International Search Report or the Declaration (PCT Rule 44.1) (3 pages) and International Search Report (5 pages) re International Application No. PCT/US 03/21750 mailed Dec. 5, 2003.
Notification of Transmittal of the International Search Report or the Declaration (PCT Rule 44.1) (3 pages) and International Search Report (3 pages) re International Application No. PCT/US 03/28137 mailed Dec. 19, 2003.
Notification of Transmittal of the International Search Report or the Declaration (PCT Rule 44.1) (3 pages) and International Search Report (5 pages) re International Application No. PCT/US 03/26124 mailed Feb. 4, 2004.
Notification of Transmittal of the International Search Report or the Declaration (PCT Rule 44.1) (3 pages) and International Search Report (6 pages) re International Application No. PCT/US 03/28138 mailed Feb. 9, 2004.
Notification of Transmittal of the International Search Report or the Declaration (PCT Rule 44.1) (3 pages) and International Search Report (6 pages) re International Application No. PCT/US 03/30126 mailed Feb. 27, 2004.
Smith, Maurice, "*Chasing Unconventional Gas Unconventionally*," CBM Gas Technology, New Technology Magazine, Oct./Nov. 2003, pp. 1-4 (5 pages).
Gardes, Robert, "*A New Direction in Coalbed Methane and Shale Gas Recovery*," (to the best of Applicants' recollection, first received at The Candian Institute Coalbed Methane Symposium conference on Jun. 16 and Jun. 17, 1002), 7 pages.
Gardes, Robert, "*Under-Balance Multi-Lateral Drilling for Unconventional Gas Recovery*," (to the best of Applicants' recollection, first received at The Unconventional Gas Revolution conference on Dec. 9, 2003, 38 pages.
Boyce, Richard G., "*High Resolution Selsmic Imaging Programs for Coalbed Methane Development*," (to the best of Applicants' recollection, first received at The Unconventional Gas Revolution conference on Dec. 10, 2003), 29 pages.
Mazzella, Mark, et al., "*Well Control Operations on a Multiwell Platform Blowout*," WorldOil.com—Online Magazine Article, vol. 22, Part 1—pp. 1-7, Jan. 2001, and Part II, Feb. 2001, pp. 1-13 (20 pages).
Vector Magnetics, LLC, Case History, California, May 1999, "*Successful Kill of a Surface Blowout*," 1999, pp. 1-12.
Cudd Pressure Control, Inc, "*Successful Well Control Operations—A Case Study: Surface and Subsurface Well Intervention on a Multi-Well Offshore Platform Blowout and Fire*," 2000, pp. 1-17, http://www.cuddwellcontrol.com/literature/successful/successful_well.htm.
Purl, R., et al., "*Damage to Coal Permeability During Hydraulic Fracturing*," SPE 21813, 1991, pp. 109-115 (8 pages).
U.S. Dept. of Energy—Office of Fossil Energy, "*Multi-Seam Well Completion Technology: Implications for Powder River Basin Coalbed Methane Production*," pp. 1-100, A-1 through A-10, Sep. 2003 (123 pages).
U.S. Dept. of Energy—Office of Fossil Energy, "*Powder River Basin Coalbed Methane Development and Produced Water Management Study*," pp. 1-111, A-1 through A-14, Nov. 2002 (213 pages).
Fletcher, Sam, "*Anadarko Cuts Route Under Canadian River Gorge*," Oil & Gas Journal, pp. 28-30, Jan. 5, 2004 (3 pages).
Kalinin, et al., Translation of Selected Pages from Ch. 4, Sections 4.1, 4.4, 4.4.1, 4.4.3, 11.2.2, 11.2.4 and 11.4, "*Drilling Inclined and Horizontal Well Bores*," Moscow, Nedra Publishers, 15 pages, 1997.
Kalinin, et al., Translation of Selected Pages from Ch. 4, Sections 4.2 (p. 135), 10.1 (p. 402), 10.4 (pp. 418-419), "*Drilling Inclined and Horizontal Well Bores*," Moscow, Nedra Publishers, 4 pages, 1997.
Arens, V. Zh., Translation of Selected Pages, "*Well-Drilling Recovery of Minerals*," Moscow, Nedra Publishers, 7 pages, 1986.
Jet Lavanway Exploration, "*Well Survey*," Key Energy Surveys, 3 pages, Nov. 2, 1997.
Precision Drilling, "*We Have Roots In Coal Bed Methane Drilling*," Technology Services Group, 1 page, Published on or before Aug. 5, 2002.
U.S. Dept. of Energy, "*New Breed of CBM/CMM Recovery Technology*, " 1 page, Jul. 2003.
Ghiselin, Dick, "*Unconventional Vision Frees Gas Reserves*," Natural Gas Quarterly, 2 pages, Sep. 2003.
CBM Review, World Coal, "*US Drilling into Asia*," 4 pages, Jun. 2003.
Skrebowski, Chris, "*US Interest in North Korean Reserves*," Petroleum, Energy Institute, 4 pages, Jul. 2003.

Zupanick, U.S. Patent Application entitled "Slant Entry Well System and Method," U.S. Appl. No. 10/004,316, Oct. 30, 2001 (WO 03/038233) (36 pages).

Zupanick, U.S. Patent Application entitled "Method and System for Underground Treatment of Materials," U.S. Appl. No. 10/142,817, May 8, 2002 (WO 03/095795 A1) (55 pages).

Zupanick, U.S. Patent Application entitled "Method and System for Controlling Pressure in a Dual Well System," U.S. Appl. No. 10/244,082, Sep. 12, 2002 (WO 2004/025072 A1) (30 pages).

Diamond et al., U.S. Patent Application entitled "Method and System for Removing Fluid From a Subterranean Zone Using an Enlarged Cavity," U.S. Appl. No. 10/264,535, Oct. 3, 2002 (37 pages).

Zupanick, U.S. Patent Application entitled "Method of Drilling Lateral Wellbores From a Slant Well Without Utilizing a Whipstock," U.S. Appl. No. 10/267,426, Oct. 8, 2002 (24 pages).

Rial et al., U.S. Patent Application entitled "Method and System for Contolling the Production Rate Of Fluid From A Subterranean Zone To Maintain Production Bore Stability In The Zone," U.S. Appl. No. 10/328,408, Dec. 23, 2002 (29 pages).

Zupanick, et al., U.S. Patent Application entitled "Method and System for Recirculating Fluid in a Well System," U.S. Appl. No. 10/457,103, Jun. 5, 2003 (41 pages).

Zupanick, et al., U.S. Patent Application entitled "Method and System for Accessing Subterranean Deposits from the Surface and Tools Therefor," U.S. Appl. No. 10/630,345, Jul. 29, 2003 (366 pages).

Pauley, Steven, U.S. Patent Application entitled "Multi-Purpose Well Bores and Method for Accessing a Subterranean Zone From the Surface," U.S. Appl. No. 10/715,300, Nov. 17, 2003 (34 pages).

Seams, Douglas, U.S. Patent Application entitled "Method and System for Extraction of Resources from a Subterranean Well Bore," U.S. Appl. No. 10/723,322, Nov. 26, 2003 (40 pages.

Zupanick, U.S. Patent Application entitled "Slant Entry Well System and Method," U.S. Appl. No. 10/749,884, Dec. 31, 2003 (28 pages).

Zupanick, U.S. Patent Application entitled "Method and System for Accessing Subterranen Deposits from the Surface," U.S. Appl. No. 10/761,629, Jan. 20, 2004 (38 pages).

Zupanick, U.S. Patent Application entitled "Method and System for Testing A Partially Formed Hydrocarbon Well for Evaluation and Well Planning Refinement," U.S. Appl. No. 10/769,221, Jan. 30, 2004 (34 pages).

Platt, "Method and System for Lining Multilateral Wells," U.S. Appl. No. 10/772,841, Feb. 5, 2004 (30 pages).

Zupanick, "Three Dimensional Well System For Accessing Subterranean Zones," Feb. 11, 2004, U.S. Appl. No. 10/777,503 (27 pages).

Zupanick, "System And Method For Directional Drilling Utilizing Clutch Assembly," U.S. Appl. No. 10/811,118, Mar. 25, 2004 (35 pages).

Zupanick et al., "Slot Cavity," U.S. Appl. No. 10/419,529, Apr. 21, 2003 (44 pages).

Palmer, Ian D., et al., "*Coalbed Methane Well Completions and Stimulations*," Chapter 14, Hydrocarbons From Coal, American Association of Petroleum Geologists, 1993, pp. 303-339.

Field, T.W., "*Surface to In-seam Drilling—The Australian Experience*," 10 pages, Undated.

Drawings included in CBM well permit issued to CNX stamped Apr. 15, 2004 by the West Virginia Department of Environmental Protection (5 pages).

Website of Mitchell Drilling Contractors, "*Services: Dymaxion—Surface to In-seam*," http://www.mitchell drilling.com/dymaxion.htm, printed as of Jun. 17, 2004, 4 pages.

Website of CH4, "About Natural Gas—Technology," http://www.ch4.com.au/ng_technology.html, copyright 2003, printed as of Jun. 17, 2004, 4 pages.

Thomson, et al., "*The Application of Medium Radius Directional Drilling for Coal Bed Methane Extraction*," Lucas Technical Paper, copyrighted 2003, 11 pages.

U.S. Department of Energy, DE-FC26-01NT41148, "*Enhanced Coal Bed Methane Production and Sequestration of CO2 in Unmineable Coal Seams*" for Consol, Inc., accepted Oct. 1, 2001, 48 pages.

U.S. Department of Energy, "*Slant Hole Drilling*," Mar. 1999, 1 page.

Desai, Praful, et al., "*Innovative Design Allows Construction of Level 3 or Level 4 Junction Using the Same Platform*," SPE/Petroleum Society of CIM/CHOA 78965, Canadian Heavy Oil Association, 2002, pp. 1-11.

Bybee, Karen, "*Advanced Openhole Multilaterals*," Horizontal Wells, Nov. 2002, pp. 41-42.

Bybee, Karen, "*A New Generation Multilateral System for the Troll Olje Field*," Multilateral/Extended Reach, Jul. 2002, 2 pages.

Emerson,, A.B., et al., "*Moving Toward Simpler, Highly Functional Multilateral Completions*," Technical Note, Journal of Canadian Petroleum Technology, May 2002, vol. 41, No. 5, pp. 9-12.

Moritis, Guntis, "*Complex Well Geometries Boost Orinoco Heavy Oil Producing Rates*," XP-000969491, Oil & Gas Journal, Feb. 28, 2000, pp. 42-46.

Themig, Dan, "*Multilateral Thinking*," New Technology Magazine, Dec. 1999, pp. 24-25.

Smith, R.C., et al., "*The Lateral Tie-Back System: The Ability to Drill and Case Multiple Laterals*," IADC/SPE 27436, Society of Petroleum Engineers, 1994, pp. 55-64, plus Multilateral Services Profile (1 page) and Multilateral Services Specifications (1 page).

Notification of Transmittal of the International Search Report or the Declaration (PCT Rule 44.1) (3 pages) and International Search Report (4 pages) re International Application No. PCT/US 03/13954 mailed Sep. 1, 2003.

Logan, Terry L., "*Drilling Techniques for Coalbed Methane*," Hydrocarbons From Coal, Chapter 12, Title Page, Copywrite Page, pp. 269-285, Copyright 1993.

Hanes, John, "*Outbursts in Leichhardt Colliery: Lessons Learned*," International Symposium-Cum-Workshop on Management and Control of High Gas Emissions and Outbursts in Underground Coal Mines, Wollongoon, NSW, Australia, Mar. 20-24, 1995, Cover page, pp. 445-449.

Williams, Ray, et al., "*Gas Reservoir Properties for Mine Gas Emission Assessment*," Bowen Basin Symposium 2000, pp. 325-333.

Brown, K., et al., "*New South Wales Coal Seam Methane Potential*," Petroleum Bulletin 2, Department of Mineral Resources, Discovery 2000, Mar. 1996, pp. i-viii, 1-96.

Fipke, S., et al., "*Economical Multilateral Well Technology for Canadian Heavy Oil*," Petroleum Society, Canadian Institute of Mining, Metallurgy & Petroleum, Paper 2002-100, to be presented in Calgary Alberta, Jun. 11-13, 2002, pp. 1-11.

Notes on Consol Presentation (by P. Thakur) made at IOGA PA in Pittsburgh, Pennsylvania on May 22, 2002 (3 pages).

Notification of Transmittal of the International Preliminary Report of Patentability (1 page) and International Preliminary Report on Patentability (12 pages) mailed Jan. 9, 2006 for International Application No. PCT/US2004/036616.

Notification Concerning Transmittal of Copy of International Preliminary Report of Patentability (Chapter 1 of the Patent Cooperation Treaty) (1 page) and International Preliminary Report on Patentability (1 page), and Written Opinion of the International Searching Authority (7 pages) mailed Dec. 22, 2005 for International Application No. PCT/US2004/017048.

European Search and Examination Report, completed Dec. 5, 2005 for Application Number EP 05020737, 5 pages.

P.C. Thakur and W.N. Poundstone, "*Horizontal Drilling Technology for Advance Degasification*," Society of Mining Engineers of AIME, Preprint No. 79-113, For presentation at the 1979 AIME Annual Meeting, New Orleans, Lousiana, Feb. 18-22, 1979, Engineering Societies Library stamp dated Feb. 5, 1980, 11 pages.

Notification Concerning Transmittal of Copy of International Preliminary Report on Patentability (1 page), International Preliminary Report on Patentability (1 page), and Written Opinion of the International Searching Authority (5 pages) mailed Feb. 9, 2006 for International Application No. PCT/US2004/024518.

Wang Weiping, "*Trend of Drilling Technology Abroad*," Petroleum Drilling and Production Technology, 1995 (vol. 17), Issue 6, www.cnki.net, 8 pages, translation, original in Chinese.
Tver, David, *The Petroleum Dictionary*, 1980, p. 221.
Rennick, et al., "*Demonstration of Safety Plugging of Oil Wells Penetrating Appalachian Coal Mines*," Bureau of Mines Coal Mine Health and Safety Research Program, Technical Progress Report—56, U.S. Department of the Interior, Jul. 1972, 25 pages.
George N. Aul and Joseph Cervik, "*Grouting Horizontal Drainage Holes in Coalbeds*," RI 8375, Bureau of Mines Report of Investigations, U.S. Department of the Interior, 1979, 21 pages.
Paul J. Componation, et al., "*Cleaning Out, Sealing and Mining Through Wells Penetrating Areas of Active Coal Mines in Northern West Virginia*," MESA Information Report 1052, U.S. Department of the Interior, 1977, 26 pages.
George S. Rice, "*Notes on the Prevention of Dust and Gas Explosions in Coal Mines*," Technical Paper 56, Bureau of Mines, Department of the Interior, copyright 1913, 12 pages.
George S. Rice, et al., "*Oil and Gas Wells Through Workable Coal Beds*," Bulletin 65, Petroleum Technology 7, Bureau of Mines, Department of the Interior, copyright 1913, 54 pages.
Notification of Transmittal of the International Preliminary Report on Patentability (1 page) and International Preliminary Report on Patentability (8 pages) for International Application No. PCT/US2005/002162 mailed May 3, 2006.
D. Nathan Meehan, "*Technology Vital For Horizontal Well Success*," Oil & Gas Journal, Dec. 11, 1995, 8 pages.
B.A. Tarr, A.F. Kuckes and M.V. Ac, "*Use of New Ranging Tool to Position a Vertical Well Adjacent to a Horizontal Well*," SPE Drilling Engineering, Jun. 1992, 7 pages.
William J. McDonald, Ph.D., John H. Cohen, and C. Mel Hightower, "*New Lightweight Fluids for Underbalanced Drilling*," believed to be on or about 1998, 10 pages.
Philip C. Crouse, "*Application and Needs for Advanced Multilateral Technologies and Strategies*," Website: www.netl.doe.gov/publications/proceedings/97/97ng/ng97_pdf/NG2-5.pdf; Believed to be on or about 1997, 9 pages.
Dan Themig, "*Multi-Laterals Providing New Options*," The American Oil & Gas Reporter, V. 39, No. 7, Jul. 1996, 4 pages.
Daniel D. Gleltman, "*Integrated Underbalanced Directional Drilling System*," Interim Report for Period of Performance Oct. 1, 1995-Feb. 14, 1996, DOE FETC Contract DE-AC21-95MC31103, Mar. 1997, 23 pages.
J.D. Gallivan, N.R. Hewitt, M. Olsen, J.M. Peden, D. Tehrani and A.A.P. Tweedie, "*Quantifying the Benefits of Multi-Lateral Producing Wells*," SPE 30441, Society of Petroleum Engineers, Inc., Copyright 1995, 7 pages.
C.A. Ehlig-Economides, G.R. Mowat and C. Corbett, "*Techniques for Multibranch Well Trajectory Design in the Context of a Three-Dimensional Reservoir Model*," SPE 35505, Society of Petroleum Engineers, Copyright 1996, 8 pages.
Stephen R. Dittoe, Albertus Retnanto, and Michael J. Economides, "*An Analysis of Reserves Enhancement in Petroleum Reservoirs with Horizontal and Multi-Lateral Wells*," SPE 37037, Society of Petroleum Engineers, Copyright 1996, 9 pages.
D.L. Boreck and M.T. Strever, "*Conservation of Methane from Colorado's Mined/Minable Coal Beds: A Feasibility Study*," Open-File Report 80-5, Colorado Geological Survey, Department of Natural Resources, Denver, Colorado, Oct. 1980, 101 pages.
B.G. kta and T. Ertekin, "*Implementation of a Local Grid Refinement Technique in Modeling Slanted, Undulating Horizontal and Multi-Lateral Wells*," SPE 56624, Society of Petroleum Engineers, Copyright 1999, 10 pages.
W.H. Leach Jr., "*New Technology for CBM Production*," Oil and Gas Investor, Opportunities in Coalbed Methane, Dec. 2002, 6 pages.
David Wagman, "*CBM Investors Keep Their Guard Up*," Oil and Gas Investor, Opportunities in Coalbed Methane, Dec. 2002, 5 pages.
Stephen D. Schwochow, "*CBM: Coming to a Basin Near You*," Oil and Gas Investor, Opportunities in Coalbed Methane, Dec. 2002, 7 pages.
"*White Paper: Guidebook on Coalbed Methane Drainage for Underground Coal Mines*," paper prepared under U.S. Environmental Protection Agency Cooperative Agreement No. CX824467-01-0 with The Pennsylvania State University by Jan M. Mutmansky, Apr. 1999, 50 pages.
M.G. Zabetakis, Maurice Deul, and M.L. Skow, "*Methane Control in United States Coal Mines—1972*," Information Circular 8600, United States Department of the Interior, Bureau of Mines Information Circular/1973, 26 pages.
B. Goktas, "*A Comparative Analysis of the Production Characteristics of Cavity Completions and Hydraulic Fractures in Coalbed Methane Reservoirs*," Society of Petroleum Engineers, SPE 55600, Copyright 1999, 10 pages.
William P. Diamond and David C. Oyler, "*Drilling Long Horizontal Coalbed Methane Drainage Holes from a Directional Surface Borehole*," Society of Petroleum Engineers, SPE/DOE 8968, 1980 6 pages.
Turgay Ertekin, Wonmo Sung, and Fred C. Schwerer, "*Production Performance Analysis of Horizontal Drainage Wells for the Degasification of Coal Seams*," Journal of Petroleum Technology, May 1988, 8 pages.
Patrick B. Tracy, "*Lateral Drilling Technology Tested on UCG Project*," IADC/SPE 17237, IADC/SPE Drilling Conference, Copyright 1988, 10 pages.
P.S. Sarkar and J.M. Rajtar, "*Transient Well Testing of Coalbed Methane Reservoirs With Horizontal Wells*," SPE 27681, Society of Petroleum Engineers, Copyright 1994, 9 pages.
R.A. Schraufnagel, D.G. Hill and R.A. McBane, "*Coalbed Methane—A Decade of Success*," SPE 28581, Society of Petroleum Engineers, Copyright 1994, 14 pages.
J.R. Kelafant, C.M. Boyer, and M.D. Zuber, "*Production Potential and Strategies for Coalbed Methane in the Central Applachian Basin*," SPE 18550, Society of Petroleum Engineers, Copyright 1988, 8 pages.
Ian Palmer, John McLennan, and Mike Kutas, "*Completions and Stimulations for Coalbed Methane Wells*," SPE 30012, Society of Petroleum Engineers, Copyright 1995, 13 pages.
John E. Jochen and Bradley M. Robinson, "*Survey of Horizontal Gas Well Activity* ," SPE 35639, Society of Petroleum Engineers, Copyright 1996, 5 pages.
R.G. Jeffrey, J.R. Enever, J.H. Wood, J.P. Connors, S.K. Choi, K.T.A. Meaney, D.A. Casey, and R.A. Koenig, "*A Stimulation and Production Experiment in a Vertical Coal Seam Gas Drainage Well*," SPE 36982, Society of Petroleum Engineers, Copyright 1996, 7 pages.
Matt C. Rowan and Michael J. Whims, "*Multilateral Well Enhances Gas Storage Deliverability*," Oil & Gas Journal, Dec. 25, 1995, 4 pages.
Dan Themig, "*Planning and Evaluation are Crucial to Multilateral Wells*," Petroleum Engineer International, Jan. 1996, 3 pages.
Larry Comeau, Randy Pustanyk, Ray Smith and Ian Gilles, "*Lateral Tie-Back System Increases Reservoir Exposure*," World Oil, Jul. 1995, 5 pages.
J. Smith, M.J. Economides and T.P. Frick, "*Reducing Economic Risk in Areally Anisotropic Formations With Multiple-Lateral Horizonal Wells*," SPE 30647, Society of Petroleum Engineers, Copyright 1995, 14 pages.
Scott Thomson, Andrew Lukas, and Duncan McDonald, "*Maximising Coal Seam Methane Extraction through Advanced Drilling Technology*," Lucas, Technical Paper, Second Annual Australian Coal Seam & Mine Methane Conference, Feb. 19-20, 2003, 14 pages.
William P. Diamond and David C. Oyler, "*Directional Drilling for Coalbed Degasification in Advance of Mining*," Proceedings of the 2nd Annual Methane Recovery from Coalbeds Symposium, Apr. 18-20, 1979, 17 pages.
John L. Stalder, Gregory, D. York, Robert J. Kopper, Carl M. Curtis and Tony L. Cole, and Jeffrey H. Copley, "*Multilateral-Horizontal Wells Increase Rate and Lower Cost Per Barrel in the Zuata Field, Faja, Venezuela*," SPE 69700, Society of Petroleum Engineers, Copyright 2001, 9 pages.
Brent Lowson, "*Multilateral-Well Planning*," Synopsis of SPE 39245, JPT, Jul. 1998, 4 pages.

A. Njaerheim, R. Rovde, E. Kvale, S.A. Kvamme, and H.M. Bjoerneli, "*Multilateral Well in Low-Productivity Zones*," Synopsis of SPE 39356, JPT, Jul. 1998, 4 pages.
S.W. Bokhari, A.J. Hatch, A. Kyei, and O.C. Werngren, "*Improved Recovery from Tight Gas Sands with Multilateral Drilling*," Synopsis of SPE 38629, JPT, Jul. 1998, 4 pages.
S.K. Vij, S.L. Narasaiah, Anup Walia, and Gyan Singh, "*Adopting Multilateral Technology*," Synopsis of SPE 39509, JPT, Jul. 1998, 3 pages.
William P. Diamond, David C. Oyler, and Herbert H. Fields, "*Directionally Controlled Drilling to Horizontally Intercept Selected Strata, upper Freeport Coalbed, Green County, PA*," Bureau of Mines Report of Investigations/1977, RI 8231, 1977, 25 pages.
David C. Oyler, William P. Diamond, and Paul W. Jeran, "*Directional Drilling for Coalbed Degasification*," Program Goals and Progress in 1978, Bureau of Mines Report of Investigations/1979, RI 8380, 1979, 17 pages.
United States Department of the Interior, "*Methane Control Research: Summary of Results, 1964-80*," Bureau of Mines Bulletin, Bulletin 687, 1988, 188 pages.
EPA, "*Identifying Opportunities for Methane Recovery at U.S. Coal Mines: Profiles of Selected Gassy Underground Coal Mines 1997-2001*," EPA Publication EPA 430-K-04-003, Jul. 2004, 2002 pages.
Marshall Deluca, "*Multilateral Completions on the Verge of Mainstream*," Offshore, Apr. 1997, 2 pages.
Bob Williams, "*Operators Unlocking North Slope's Viscous Oil Commerciality*," Oil & Gas Journal, Aug. 6, 2001, 5 pages.
James P. Oberkircher, "*The Economic Viability of Multilateral Wells*," IADC/SPE 59202, Society of Petroleum Engineers, Copyright 2000, 10 pages.
Jim Oberkircher, "*What is the Future of Multilateral Technology?*," World Oil, Jun. 2001, 3 pages.
Rick Von Flatern, "*Operators Are Ready For More Sophisticated Multilateral Well Technology*," Petroleum Engineer International , Jan. 1996, 4 pages
Kyle S. Graves, "*Multiple Horizontal Drainholes Can Improve Production*," Oil & Gas Journal, OGJ Special, Feb. 14, 1994, 5 pages.
Guntis, Moritis, "*Sincor Nears Upgrading, Plateau Production Phase*," Oil & Gas Journal, Oct. 29, 2001, 1 pages.
Guntis, Moritis, "*Smart, Intelligent Wells*," Oil & Gas Journal, Apr. 2, 2001, 6 pages.
Craig Coull, "*Intelligent Completion Provides Savings for Snorre TLP*," Oil & Gas Journal, Apr. 2, 2001, 2 pages.
D.T. Vo and M.V. Madden, "*Performance Evaluation of Trilateral Wells: Field Examples*," SPE 28376, Society of Petroleum Engineers, copyright 1994, 16 pages.
Dean E. Gaddy, "*Pioneering Work, Economic Factors Provide Insights Into Russian Drilling Technology*," Oil & Gas Journal, Jul. 6, 1998, 3 pages.
"*Optimal Multilateral-Well Design for a Heavy-Oil Reservoir*," Synopsis of SPE 37554 by D.W. Boardman, JPT, Jul. 1997, 3 pages.
"*Multilateral-Well Completion-System Advances*," Synopsis of SPE 39125 by J.R. Longbottom et al., JPT, Jul. 1997, 3 pages.
"*Optimal Multilateral/Multibranch Completions*," Synopsis of SPE 38033 by Hironori Sugiyama et al., JPT, Jul. 1997, 5 pages.
"*Multilateral Experiences: IDD El Shargi North Dome Field (Qatar)*," Synopsis of SPE 37675 by J.R. Scofield et al., JPT, Jul. 1997, 3 pages.
"*Moving Toward the 'Intelligent Well'*," Synopsis of SPE 39126 by Clark E. Robison, JPT, Jul. 1997, 3 pages.
"*Short-Radius Laterals: An Operator's Experience*," Synopsis of SPE 37493 by C. Ellis et al., JPT, Jul. 1997, 3 pages.
"*Analyzing a Multilateral-Well Failure*," Synopsis of SPE 38268 by A. Ray Brister, JPT, Jul. 1997, 3 pages.
"*A New Concept for Multibranch Technology*," Synopsis of SPE 39123 by Mark Stracke et al, JPT, Jul. 1997, 3 pages.
"*Classification Clarifies Multilateral Options*," Synopsis of SPE 38493 by C. Hogg, JPT, Jul. 1997, 3 pages.
"*Infill Development With Multilateral-Well Technology*," Synopsis of SPE 38030 by Sau-Wai Wong et al., JPT, Jul. 1997, 3 pages.
Brad Califf and Denny Kerr, "*UPRC Completes First Quad-Lateral Well*," Petroleum Engineer International, Sep. 1993, 4 pages.
Jack Winton, "*Use of Multi-lateral Wells to Access Marginal Reservoirs*," OFFSHORE, Feb. 1999, 3 pages.
J.R. Salas, P.J. Clifford and D.P. Jenkins, "*Brief: Multilateral Well Performance Prediction*," JPT, Sep. 1996, 3 pages.
Mike R. Chambers, "*Multilateral Technology Gains Broader Acceptance*," Oil & Gas Journal, Nov. 23, 1998, 5 pages.
S. Ikeda, T. Takeuchi, and P.C. Crouse, "*An Investigative Study on Horizontal Well and Extended Reach Technologies With Reported Problem Areas and Operational Practice in North America and Europe*," IADC/SPE 35054, Society of Petroleum Engineers, Copyright 1996, 8 pages.
Greg Nazzal, "*Extended-Reach Wells Tap Outlying Reserves*," World Oil, Mar. 1993, 8 pages.
Bambang Tjondrodiputro, Harry Eddyarso and Kim Jones, "*How ARCO Drills High-Angle Wells Offshore Indonesia*," World Oil, Mar. 1993, 11 pages.
S. Hovda, et al., "*World's First Application of a Multilateral System Combining a Cased and Cemented Junction With Fullbore Access to Both Laterals*," SPE 36488, Society of Petroleum Engineers, Copyright 1996, 15 pages.
Robert A. Gardes, "*Micro-annulus Under-balanced Drilling of Multilateral Wells*," OFFSHORE, May 1996, 4 pages.
Brent Lowson, "*Phillips Multilateral Features Several Firsts for North Sea*," OFFSHORE, Feb. 1997, 2 pages.
J.R. Scofield, B. Laney and P. Woodard, "*Field Experience With Multi-Laterals in the Idd El Shargi North Dome Field (Qatar)*," SPE/IADC 37675, Society of Petroleum Engineers, Copyright 1997, 11 pages.
Jeremy Beckman, "*Coiled Tubing, Reamer Shoes Push Through Barriers in North Sea Wells*," OFFSHORE, Feb. 1997, 1 page.
C.H. Fleming, "*Comparing Performance of Horizontal Versus Vertical Wells*," World Oil, Mar. 1993, 7 pages.
Larry A. Cress and Stephen W. Miller, "*Dual Horizontal Extension Drilled Using Retrievable Whipstock*," World Oil, Jun. 1993, 9 pages.
Guntis Moritis, "*Heavy Oil Expansions Gather Momentum Worldwide*," Oil & Gas Journal, Aug. 14, 1995, 6 pages.
K.W. Hart and L.V. Jankowski, "*The Application of Slant Hole Drilling in Development of Shallow Heavy Oil Deposits*," The Journal of Canadian Petroleum Technology, Jan.-Feb. 1984, Montreal, 6 pages.
Jeff Smith and Bob Edwards, "*Slant Rigs Offer Big Payoffs in Shallow Drilling*," Oil & Gas Journal, Mar. 30, 1992, 3 pages.
Ravil Gabdullinovich Salikhov, Evgeny Fedyorovich Dubrovin, and Vladimir Vladimirovich Sledkov, "*Cluster and Dual-Lateral Drilling Technologies Optimize Russian Well Production*," Oil & Gas Journal, Nov. 24, 1997, 7 pages.
Dean E. Gaddy, "*Inland Barge to Allow Cluster Drilling in Nigeria*," Oil & Gas Journal, Aug. 30, 1999, 7 pages.
Cliff Hogg, "*Comparison of Multilateral Completion Scenarios and Their Application*," SPE 38493, Society of Petroleum Engineers, Copyright 1997, 11 pages.
S.W. Bokhari, A.J. Hatch, A. Kyei and O.C. Wemgren, "*Improved Recoveries in the Pickerill Field from Multilateral Drilling into Tight Gas Sands*," SPE 38629, Society of Petroleum Engineers, Copyright 1997, 15 pages.
J.R. Longbottom, Dana Dale, Kevin Waddell, Scott Bruha, and John Roberts, "*Development, Testing, and Field Case Histories of Multilateral Well Completion Systems*," SPE 36994, Society of Petroleum Engineers, Copyright 1996, 16 pages.
E.J. Antczak, D.G.L. Smith, D.L. Roberts, Brent Lowson, and Robert Norris, "*Implementation of an Advanced Multi-Lateral System With Coiled Tubing Accessibility*," SPE/IADC 37673, Society of Petroleum Engineers, Copyright 1997, 9 pages.
H. Azoba, O. Akinmoladun, H. Rothenhofer, D. Kent and N. Nawfal, "*World Record Dual- and Tri-lateral Wells*," SPE/IADC 39240, Society of Petroleum Engineers, Copyright 1997, 6 pages.
R.W. Taylor and Rick Russell, "*Case Histories: Drilling and Completing Multilateral Horizontal Wells in the Middle East*," SPE/IADC 39243, Society of Petroleum Engineers, Copyright 1997, 14 pages.

D.K. Triolo and R.A. Mathes, "*Review of a Multi-Lateral Drilling and Stimulation Program*," SPE/IADC 39242, copyright 1997, Society of Petroleum Engineers, 13 pages.
John H. Perry, Leonard J. Prosser, Jr., Joseph Cervik, "*Methane Drainage from the Mary Lee Coalbed, Alabama, Using Horizontal Drilling Techniques*," SPE/DOE 8967, Society of Petroleum Engineers, May 18, 1980, 6 pages.
Gerald L. Finfinger, Leonard J. Prosser, and Joseph Cervik, "*Influence of Coalbed Characteristics and Geology on Methane Drainage*," SPE/DOE 8964, Society of Petroleum Engineers, May 18, 1980, 6 pages.
Hilmer Von Schonfeldt, B. Rao Pothini, George N. Aul and Roger L. Henderson, "*Production and Utilization of Coalbed Methane Gas in Island Creek Coal Company Mines*," SPE/DOE 10817, Society of Petroleum Engineers, May 16, 1982, 10 pages.
Joseph Cervik, H.H. Fields, and G.N. Aul, "*Rotary Drilling Holes in Coalbeds for Degasification*," RI 8097, Bureau of Mines Reporting of Investigations, 1975, 26 pages.
D.G. Masszi and A.A. Kahil, "*Coal Demethanation Principles and Field Experience*," The Journal of Canadian Petroleum Technology, Jul.-Aug. 1982, 4 pages.
Tobias W. Goodman, Joseph Cervik, and George N. Aul, "*Degasification Study From an Air Shaft in the Beckley Coalbed*," RI 8675, Bureau of Mines Report of Investigations, 1982, 23 pages.
P.C. Thakur and H.D. Dahl, "*Horizontal Drilling—A Tool for Improved Productivity*," Mining Engineering, Mar. 1982, 3 pages.
P.C. Thakur and J.G. Davis II, "*How to Plan for Methane Control in Underground Coal Mines*," Mining Engineering, Oct. 1977, 5 pages.
A.B. Yost II and B.H. Javins, "*Overview of Appalachian Basin High-Angle and Horizontal Air and Mud Drilling*," SPE 23445, Society of Petroleum Engineers, Oct. 22, 1991, 14 pages.
Pramod C. Thakur, "*Methane Flow in the Pittsburgh Coal Seam*," Third International Mine Ventilation Congress, England, U.K., Jun. 13-19, 1984, 17 pages.
Chapter 10 by Pramod C. Thakur, "*Methane Control for Longwall Gobs*," Longwall-Shortwall Mining, State of the Art by R.V. Ramani, published by New York: Society of Mining Engineers of the American Institute of Mining, Metallurgical, and Petroleum Engineers, 1981, 7 pages.
Pramod C. Thakur, Stephen D. Lauer, and Joseph Cervik, "*Methane Drainge With Cross-Measure Boreholes on a Retreat Longwall Face*," Preprint No. 83-398, Society of Mining Engineers of AIME, for presentation at the SME-AIME Fall Meeting and Exhibit, Salt Lake City, Utah, Oct. 19-21, 1983, 14 pages.
Warren F. Dobson and Daniel R. Seelye, "*Mining Technology Assists Oil Recovery from Wyoming Field*," SPE 9418, Society of Petroleum Engineers of AIME, Copyright 1980, 7 pages.
T.L. Logan, J.J. Schwoebel and D.M. Horner, "*Application of Horizontal Drainhole Drilling Technology for Coalbed Methane Recovery*," SPE/DOE 16409, Society of Petroleum Engineers/U.S. Department of Energy, Copyright 1997, 12 pages.
Samuel O. Osisanya and Robert F. Schaffitzel, "*A Review of Horizontal Drilling and Completion Techniques for Recovery of Coalbed Methane*," SPE 37131, Society of Petroleum Engineers, Copyright 1996, 13 pages.
S.D. Joshi, "*A Review of Horizontal Well and Drainhole Technology*," SPE 16868, Society of Petroleum Engineers, Copyright 1987, 17 pages.
R. Bitto, A.B. Henderson and L. Broussard, "*Recent Case Histories of New Well Applications for Horizontal Drilling*," SPE 21262, Society of Petroleum Engineers, Copyright 1990, 12 pages.
M.R. Konopczynski, John Hughes and J.E. Best, "*A Novel Approach to Initiating Multi-Lateral Horizontal Wells*," SPE/IADC 29385 , Society of Petroleum Engineers, Copyright 1996, 11 pages.
Kelly Falk and Craig McDonald, "*An Overview of Underbalanced Drilling Applications in Canada*," SPE 30129 , Society of Petroleum Engineers, Copyright 1995, 9 pages.
"*Evolution Toward Simpler, Less Risky Multilateral Wells*," World Oil, prepared from paper SPE/IADC 67825 by Adam Pasicznyk, Jun. 2001, 8 pages.
"*How Multilateral Boreholes Impact Ultimate Recovery Strategies*," OFFSHORE, Jul. 1997, 6 pages.
"*Trilateral Horizontal Wells Add 10 Million bbl for Unocal*," OFFSHORE, Dec. 1993, 2 pages.
Nicholas P. Chironis, "*New Borehole Techniques Offer Hope for Gassy Mines*," Coal Age, Jan. 1973, 4 pages.
A. Retnanto, T.P. Frick, C.W. Brand, and M.J. Economides, "*Optimal Configurations of Multiple-Lateral Horizontal Wells*," SPE 35712, Society of Petroleum Engineers, Copyright 1996, 8 pages.
T.L. Logan, "*Horizontal Drainhole Drilling Techniques Used for Coal Seam Resource Exploitation*," SPE 18254, Society of Petroleum Engineers, Copyright 1988, 13 pages.
David Hill, Eric Neme, Christine Enlig-Economides and Miguel Mollinedo, "*Reentry Drilling Gives New Life to Aging Fields*," Oilfield Review, Autumn 1996, 14 pages.
R.L. Thoms and R.M. Gehle, "*Feasibility of Controlled Solution Mining From horizontal Wells*," Solution Mining Research Institute, Oct. 24-27, 1993, 8 pages.
"*World's First Trilateral Horizontal Wells on Stream*," Oil & Gas Journal, Nov. 29, 1993, 2 pages.
Margaret A. Adams, Jeanne L. Hewitt and Rodney D. Malone, "*Coalbed Methane Potential of the Appalachians*," SPE/DOE 10802, Society of Petroleum Engineers, Copyright 1982, 10 pages.
F.C. Schwerer and A.M. Pavone, "*Effect of Pressure-Dependent Permeability on Well-Test Analyses and Long-Term Production of Methane From Coal Seams*," SPE/DOE/GRI 12857, Society of Petroleum Engineers, Copyright 1984, 10 pages.
Stephen Krickovic and J.D. Kalasky, "*Methane Emission Rate Study in a Deep Pocahontas No. 3 Coalbed Mine in Conjunction With Drilling Degasification Holes in the Coalbed*," RI-7703, Bureau of Mines Report of Investigations/1972, United States Department of the Interior, 1972, 15 pages.
H.H. Fields, Joseph Cervik, and T.W. Goodman, "*Degasification and Production of Natural Gas From an Air Shaft in the Pittsburgh Coalbed*," RI-8173, Bureau of Mines Report of Investigations/1976, United States Department of the Interior, 1976, 28 pages.
Gerald L. Finfinger and Joseph Cervik, "*Drainage of Methane From the Overlying Pocahontas No. 4 Coalbed From Workings in the Pocahontas No. 3 Coalbed*," RI-8359, Bureau of Mines Report of Investigations/1979, United States Department of the Interior, 1979, 19 pages.
Gerald L. Finfinger and Joseph Cervik, "*Review of Horizontal Drilling Technology for Methane Drainage From U.S. Coalbeds*," IC-8829, Bureau of Mines Information Circular/1980, United States Department of the Interior, 1980, 24 pages.
Andre P. Jourdan and Guy A. Baron, "*Elf Drills 1,000 + Ft Horizontally*," Petroleum Engineer International, Sep. 1981, 4 pages.
P.F. Conti, "*Controlled Horizontal Drilling*," SPE/IADC 18708, Society of Petroleum Engineers, Copyright 1989, 6 pages.
Armando R. Navarro, "*Innovative Techniques Cut Costs in Wetlands Drilling*," Oil & Gas Journal, Oct. 14, 1991, 4 pages.
Victor M. Luhowy and Peter D. Sametz, "*Horizontal Wells Prove Effective in Canadian Heavy-Oil Field*," Oil & Gas Journal, Jun. 28, 1993, 6 pages.
D. Lane Becker, "*Project Management Improved Multiwell Shallow Gas Development*," Oil & Gas Journal, Oct. 16, 1995, 5 pages.
Mike R. Chambers, "*Junction Design Based on Operational Requirements*," Oil & Gas Journal, Dec. 7, 1998, 7 pages.
A.J. Branch, et al., "*Remote Real-Time Monitoring Improves Orinoco Drilling Efficiency*," Oil & Gas Journal, May 28, 2001, 6 pages.
D. Keith Murray, "*Deep Coals Hold Big Part of Resource*," The American Oil & Gas Reporter, May 2002, 8 pages.
Nestor Rivera, et al., "*Multilateral, Intelligent Well Completion Benefits Explored*," Oil & Gas Journal, Apr. 14, 2003, 10 pages.
Handbook on Coal Bed Methane Produced Water: Management and Beneficial Use Alternatives, prepared by ALL Consulting, Jul. 2003, 321 pages.
Nikola Maricic, "*Parametric and Predictive Analysis of Horizontal Well Configurations for Coalbed Methane Reservoirs in Applachian Basin*" Thesis, West Virginia University, Department of Petroleum and Natural Gas Engineering, 2004, 162 pages.
Nikola Maricic, Shahab D. Mohaghegh, and Emre Artun,"*A Parametric Study on the Benefits of Drilling Horizontal and Multilateral*

*Wells in Coalbed Methane Reservoirs*," SPE 96018, Society of Petroleum Engineers, Copyright 2005, 8 pages.

D.P. Schlick and J.W. Stevenson, "*Methane Degasification Experience at Jim Walters's*," Proceedings of the Twelfth Annual Institute on Coal Mining Health, Safety and Research, Aug. 25-27, 1981.

P.C. Thakur, "*Optimum Methane Drainage in Gassy Coal Mines*," 2003 SME Annual Meeting, copyright 2003 by SME, 4 pages.

Global Methane and the Coal Industry: A Two-Part Report on Methane Emissions from the Coal Industry and Coalbed Methane Recovery and Use, Coal Industry Advisory Board, International Energy Agency, copyright 1994, 72 pages.

Pratt et al., U.S. Patent Application entitled "Cavity Well System," U.S. Appl. No. 11/141,335, May 31, 2005, 19 pages.

Paul F. Conti and Michael Schumacher, "Solution Mining in the Nineties," Presented at the Fall 1991 Meeting of the Solution Mining Research Institute, Oct. 27-30, 1991, 11 pages.

Notification of Transmittal of the International Preliminary Report on Patentability (1 page), International Preliminary Report on Patentability (7 pages) and Amended Sheets (9 pages) for International Application No. PCT/US2004/012029 mailed Aug. 11, 2005.

Notification Concerning Transmittal of Copy of International Preliminary Report on Patentability (1 page), and Written Opinion (5 pages) for International Application No. PCT/US2005/005289 mailed Sep. 8, 2006.

Invitation to Pay Additional Fees (2 pages) and Annex to Form PCT/ISA/206 Communication Relating to the Results of the Partial International Search (3 pages) for International Application No. PCT/US2006/021057 mailed Sep. 11, 2006.

Kalinin, D.G., et al., Translation of Selected Pages, "Boring Direction and Horizontal Wells," Moscow, "Nedra", 1997, p. 11-12, 148-152 (15 pages).

Evaluation of Coalbed Methane Well Types in the San Juan Basin, prepared by Malkewicz Hueni Associates, Inc. for The Bureau of Land Management, Mar. 2004, 23 pages.

SYSTEM AND METHOD FOR MULTIPLE WELLS FROM A COMMON SURFACE LOCATION

TECHNICAL FIELD

The present invention relates generally to the field of subterranean exploration and drilling and, more particularly, to a system and method for multiple wells from a common surface location.

BACKGROUND

Subterranean deposits of coal contain substantial quantities of entrained methane gas. Limited production in use of methane gas from coal deposits has occurred for many years. Substantial obstacles, however, have frustrated more extensive development in use of methane gas deposits in coal seams. The foremost problem in producing methane gas from coal seams is that while coal seams may extend over large areas of up to several thousand acres, the coal seams are fairly shallow in depth, varying from a few inches to several meters. Thus, while the coal seams are often relatively near the surface, vertical wells drilling into the coal deposits for obtaining methane gas can only drain a fairly small radius around the coal deposits. Further, coal deposits are not amenable to pressure fracturing and other methods often used for increasing methane gas production from rock formations. As a result, once the gas easily drained from a vertical well bore in a coal seam is produced further production is limited in volume. Additionally, coal seams are often associated with subterranean water, which must be drained from the coal seam in order to produce the methane.

Horizontal drilling patterns have been tried in order to extend the amount of coal seams exposed to a drill bore for gas extraction. Such horizontal drilling techniques, however, require the use of a radiused well bore which presents difficulties in removing the entrained water from the coal seams. The most efficient method for pumping water from a subterranean well, a sucker rod pump, does not work well in horizontal or radiused bores.

SUMMARY

The present invention provides a system and method using multiple articulated and drainage wells from a common surface well that substantially eliminates, reduces, or minimizes the disadvantages and problems associated with previous systems and methods. In particular, certain embodiments of the present invention provide a system and method using multiple articulated and drainage wells from a single surface well for efficiently producing and removing entrained methane gas and water from a coal seam without requiring that multiple wells be drilled from the surface.

In accordance with one embodiment of the present invention, a system for accessing a subterranean zone from an entry well including an entry well extending from the surface. The entry well has a substantially vertical portion. One or more drainage wells extend from the entry well to a subterranean zone. One or more articulated wells extend from the entry well to the subterranean zone. At least one of the articulated wells intersects at least one of the one or more drainage wells at a junction proximate the subterranean zone. A drainage pattern is formed coupled to the junction and operable to conduct fluids from the subterranean zone to the junction.

The technical advantage of the present invention include providing a method and system for using multiple articulated and drainage wells from a common surface well. In particular, a technical advantage may include the formation of an entry well, a plurality of drainage wells, a plurality of articulated wells, and drainage patterns from a single surface location to minimize the number of surface wells needed to access a subterranean zone for draining of gas and liquid resources. This allows for more efficient drilling and production and greatly reduces costs and problems associated with other systems and methods.

Other technical advantages of the present invention will be readily apparent to one skilled in the art from the following figures, description, and claims.

BRIEF DESCRIPTION OF THE DRAWINGS

For a more complete understanding of the present invention and its advantages, reference is now made to the following description taken in conjunction with the accompanying drawings, wherein like numerals represent like parts, in which.

DETAILED DESCRIPTION OF THE DRAWINGS

Figure 1:
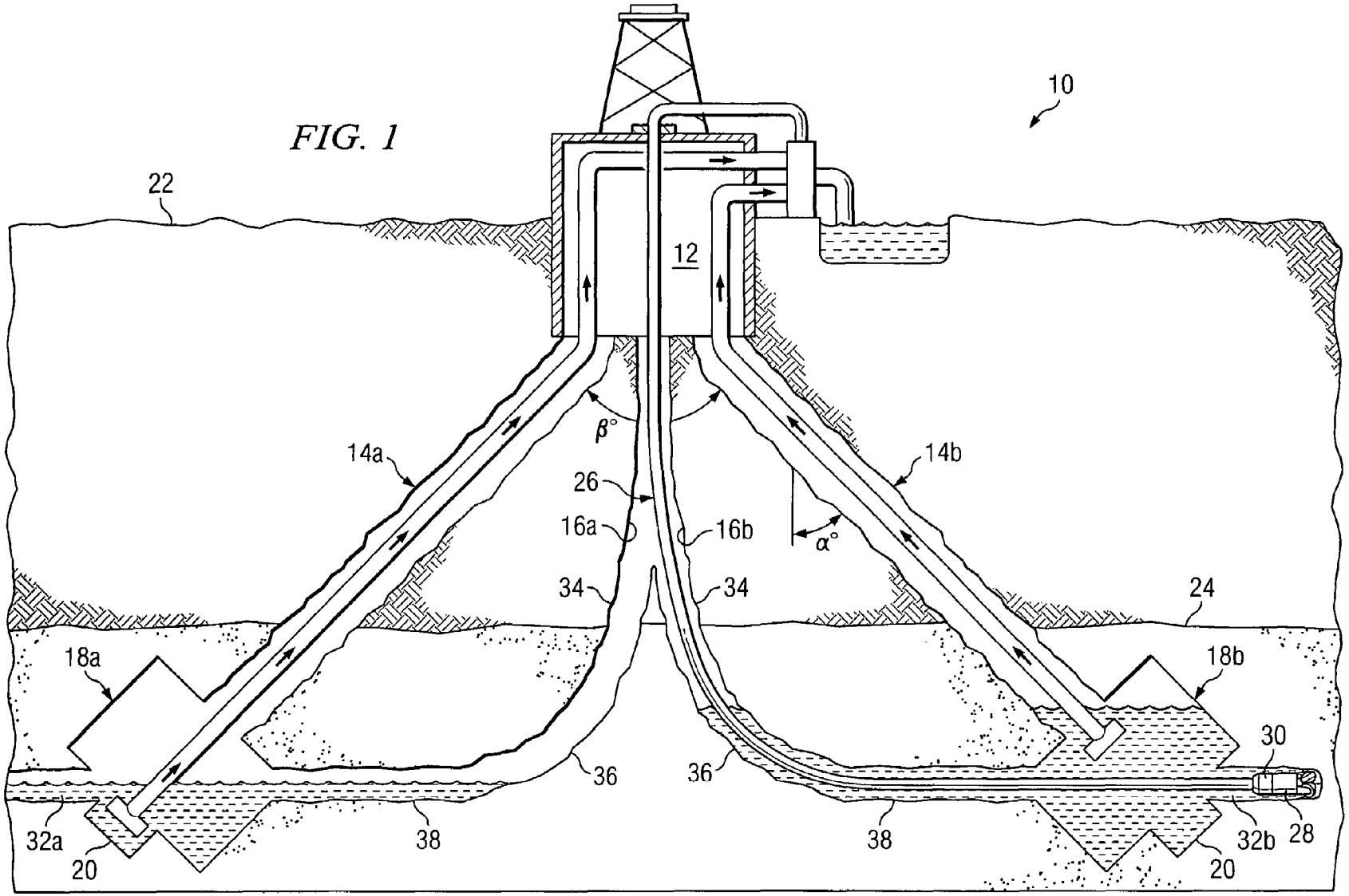
FIG. 1 is a cross-sectional diagram illustrating a system for accessing a subterranean zone through multiple wells drilled from a common surface well.

FIG. 1 is a diagram illustrating a system 10 for accessing a subterranean zone using multiple articulated and drainage wells from a common surface well in accordance with an embodiment of the present invention. In particular embodiments, the subterranean zone is a coal seam. However, it should be understood that other subterranean zones can be similarly accessed using system 10 of the present invention to remove and/or produce water, hydrocarbons and other fluids from the zone, to treat minerals in the zone prior to mining operations, or to inject, introduce, or store a fluid or other substance into the zone.

Referring to FIG. 1, system 10 includes an entry well 12, drainage wells 14, articulated wells 16, cavities 18, and sumps 20. Entry well 12 extends from surface 22 towards subterranean zone 24. Drainage wells 14 extend from the terminus of entry well 12 to subterranean zone 24, although drainage wells 14 may alternatively extend from any other suitable portion of entry well 12. Articulated wells 16 also may extend from the terminus of entry well 12 to subterranean zone 24 and may each intersect a corresponding drainage well 14. Cavity 18 and sump 20 may be located at the intersection of an articulated well 16 and a corresponding drainage well 14.

Entry well 12 is illustrated as being substantially vertical; however, it should be understood that entry well 12 may be formed at any suitable angle relative to surface 22 to accommodate, for example, surface geometries and attitudes and/or the geometric configuration or attitude of a subterranean resource. In the illustrated embodiment, drainage wells 14 are formed as slant wells that angle away from entry well 12 at an angle designated α. The angle α depends, in part, on the depth of subterranean zone 24. It will be understood that drainage wells 14 may be formed at other angles to accommodate surface topologies and other factors similar to those affecting entry well 12. Furthermore, although drainage wells 14 are illustrated as having the same angle of slant over their entire length (below entry well 12), drainage wells 14 may have two or more portions below entry well 12 that are at different angles. For example, the portion of drainage wells 14 from which cavity 18 is formed and/or which is intersected by the corresponding articulated well 16 may be substantially vertical. In the illustrated embodiment, drainage wells 14 are formed in relation to each other at an angular separation of β degrees. In one embodiment, the angle β equals twice the angle α. It will be understood that drainage wells 14 may be separated by other angles depending likewise on the topology and geography of the area and location of subterranean zone 24.

In particular embodiments, an enlarged cavity 18 may be formed from each drainage well 14 at the level of subterranean zone 24. As described in more detail below, cavity 18 provides a junction for the intersection of drainage well 14 by a corresponding articulated well 16 used to form a subterranean drainage bore pattern in subterranean zone 24. Cavity 18 also provides a collection point for fluids drained from subterranean zone 24 during production operations. In one embodiment, cavity 18 has a radius of approximately eight feet; however, any appropriate diameter cavity may be used. Cavity 18 may be formed using suitable under-reaming techniques and equipment. A portion of drainage well 14 may continue below cavity 18 to form a sump 20 for cavity 18. Although cavities 18 and sumps 20 are illustrated, it should be understood that particular embodiments do not include a cavity and/or a sump.

Each articulated well 16 extends from the terminus of entry well 12 to cavity 18 of a corresponding drainage well 14 (or to the drainage well 14 if no cavity is formed). Each articulated well 16 includes a first portion 34, a second portion 38, and a curved or radiused portion 36 interconnecting portions 34 and 38. In FIG. 1, portion 34 is illustrated substantially vertical; however, it should be understood that portion 34 may be formed at any suitable angle relative to surface 22 to accommodate surface 22 geometric characteristics and attitudes and/or the geometric configuration or attitude of subterranean zone 24. Portion 38 lies substantially in the plane of subterranean zone 24 and intersects the large diameter cavity 18 of a corresponding drainage well 14. In FIG. 1, the plane of subterranean zone 24 is illustrated substantially horizontal, thereby resulting in a substantially horizontal portion 38; however, it should be understood that portion 38 may be formed at any suitable angle relative to surface 22 to accommodate the geometric characteristics of subterranean zone 24. Each articulated well 16 may be drilled using an articulated drill string 26 that includes a suitable down-hole motor and a drill bit 28. A measurement while drilling (MWD) device 30 may be included in articulated drill string 26 for controlling the orientation and direction of a well bore drilled by the motor and bit 28. Any suitable portion of articulated well 16 may be lined with a suitable casing.

In the illustrated embodiment, drainage well 14 is sufficiently angled away from a corresponding articulated well 16 to permit the large radiused curved portion 36 and any desired portion 38 to be drilled before intersecting cavity 18. In particular embodiments, curved portion 36 may have a radius of one hundred to one hundred fifty feet; however, any suitable radius may be used. This angle α may be chosen to minimize the angle of curved portion 36 to reduce friction in articulated well 16 during drilling operations. As a result, the length of articulated well 16 is maximized.

After cavity 18 has been successfully intersected by articulated well 16, drilling is continued through cavity 18 using articulated well string 26 to provide a drainage bore pattern 32 in subterranean zone 24. In FIG. 1, drainage bore pattern 32 is illustrated substantially horizontal corresponding to a substantially horizontally illustrated subterranean zone 24; however, it should be understood that drainage bore pattern 32 may be formed at any suitable angle corresponding to the geometric characteristics of subterranean zone 24. During this operation, gamma ray logging tools and conventional MWD devices may be employed to control and direct the orientation of drill bit 28 to retain drainage bore pattern 32 within the confines of subterranean zone 24 and to provide substantially uniform coverage of a desired area within subterranean zone 24. Drainage bore pattern 32 may comprise a single drainage bore extending into subterranean zone 24 or it may comprise a plurality of drainage bores. Further information regarding an example drainage bore pattern 32 is described in more detail below. In addition, although pattern 32 is illustrated as extending from cavity 18, portion 38 of articulated wells 16 may be extended appropriately so that portion 38 serves the function of draining fluids from the subterranean zone 24.

During the process of drilling drainage bore pattern 32 in a coal seam or other appropriate formations, drilling fluid or "mud" may be pumped down articulated drill string 26 and circulated out of drill string 26 in the vicinity of a bit 28, where it is used to scour the formation and to remove formation cuttings. The cuttings are then entrained in the drilling fluid which circulates up through the annulus between drill string 26 and the walls of articulated well 16 until it reaches surface 22, where the cuttings are removed from the drilling fluid and the fluid is then recirculated. This conventional drilling operation produces a standard column of drilling fluid having a vertical height equal to the depth of articulated well 16 and produces a hydrostatic pressure on the well bore corresponding to the well bore depth. Because coal seams tend to be porous and fractured, they may be unable to sustain such hydrostatic pressure, even if formation water is also present in subterranean zone 24. Accordingly, if the full hydrostatic pressure is allowed to act on subterranean zone 24, the result may be loss of drilling fluid in entrained cuttings into the formation. Such a circumstance is referred to as an "over-balanced" drilling operation in which they hydrostatic fluid pressured in the well bore exceeds the ability of the formation to withstand the pressure. Loss of drilling fluids and cuttings into the formation not only is expensive in terms of the lost drilling fluids, which must be made up, but also tends to plug the pores in subterranean zone 24, which are needed to drain the coal seam of gas and water.

To prevent over-balanced drilling conditions during formation of drainage bore pattern 32, air compressors or other suitable pumps may be provided to circulate compressed air or other suitable fluids down drainage wells 14 and back up through corresponding articulated wells 16. The circulated air or other fluid will mix with the drilling fluid in the annulus around the articulated drill string 26 and create bubbles throughout the column of drilling fluid. This has the effect of lightening the hydrostatic pressure of the drilling fluid and reducing the down-hole pressure significantly that drilling conditions do not become over-balanced. Aeration of the drilling fluid reduces down-hole pressure to approximately 150–200 pounds per square inch (psi). Accordingly, low pressure coal seams and other subterranean zones can be drilled without substantial loss of drilling fluid and contamination of the zone by the drilling fluid. Alternatively, tubing may be inserted into drainage well 14 such that air pumped down through the tubing forces the fluid back through the annulus between the tubing and drainage well 14.

In yet another embodiment, a down-hole pumping unit 40 may be installed in cavity 18, as illustrated in FIG. 1, to pump drilling fluid and cuttings to surface 22 through drainage well 14. This eliminates the friction of air and fluid returning through articulated well 16 and may reduce down-hole pressure to nearly zero.

Foam, which may be compressed air mixed with water, may also be circulated down through the articulated drill string 26 along with the drilling mud in order to aerate the drilling fluid in the annulus as articulated well 16 is being drilled and, if desired, as drainage bore pattern 32 is being drilled. Drilling of drainage bore pattern 32 with the use of an air hammer bit or an air-powered down-hole motor will also supply compressed air or foam to the drilling fluid. In this case, the compressed air or foam which is used to power the down-hole motor and bit 28 exits articulated drill string 26 in the vicinity of drill bit 28. However, the larger volume of air which can be circulated down drainage wells 14 permits greater aeration of the drilling fluid than generally is possible by air supplied through articulated drill string 26.

Figure 2:
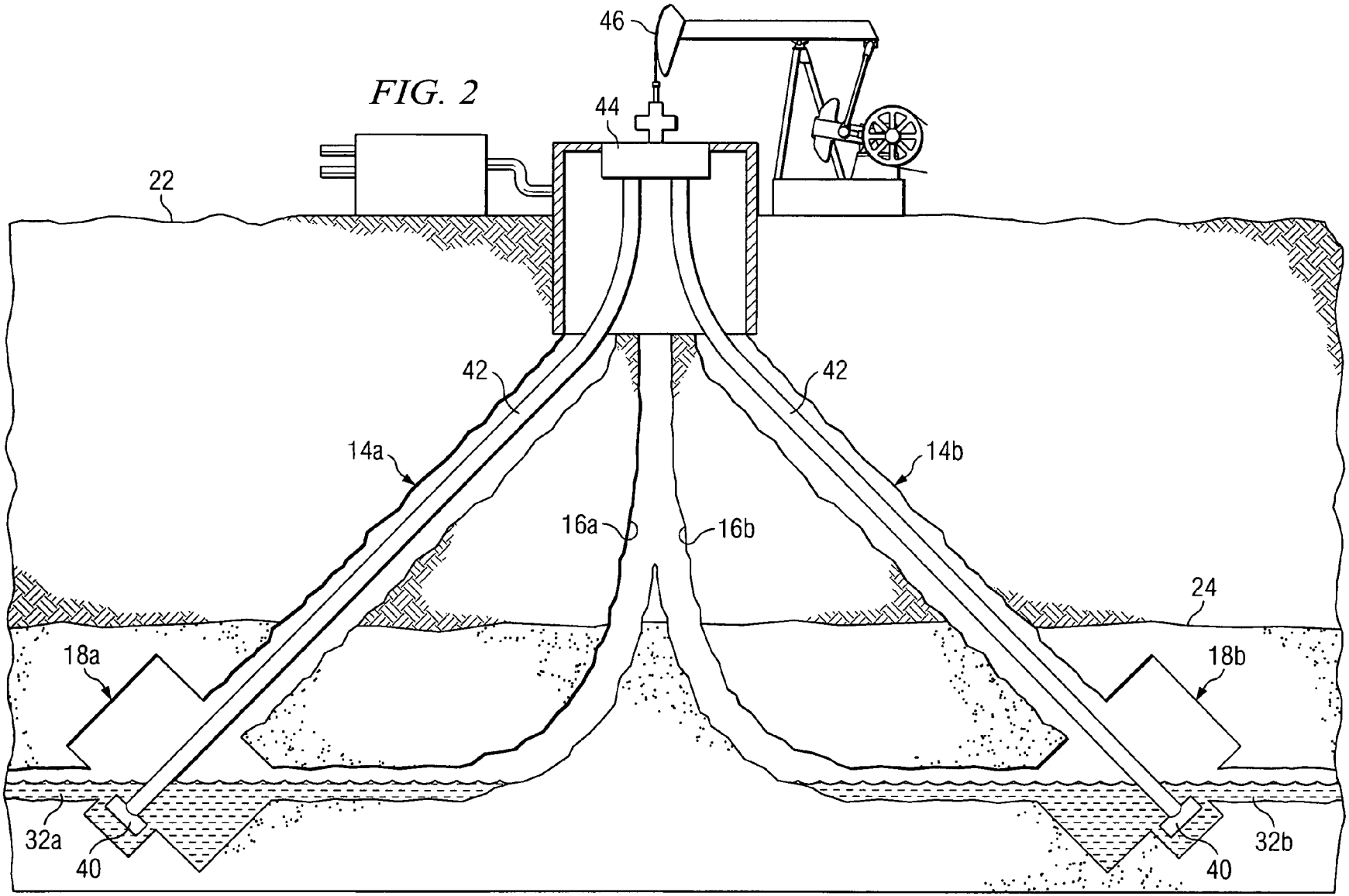
FIG. 2 is a cross-sectional diagram illustrating production of fluids from a subterranean zone through a well bore system in accordance with one embodiment of the present invention.

FIG. 2 illustrates production of fluids from drainage bore pattern 32*a* and 32*b* in subterranean zone 24 in accordance with one embodiment of the present invention. In this embodiment, after wells 14 and 16, respectively, as well as desired drainage bore patterns 32, have been drilled, articulated drill string 26 is removed from articulated wells 16. In particular embodiments, articulate wells may be suitably plugged to prevent gas from flowing through articulate wells 16 to the surface 22.

Referring to FIG. 2, the inlets for down-hole pumps 40 or other suitable pumping mechanisms are disposed in drainage wells 14 in their respective cavities 18. Each cavity 18 provides a reservoir for accumulated fluids allowing intermittent pumping without adverse effects of a hydrostatic head caused by accumulated fluids in the well bore. Each cavity 18 also provides a chamber for gas/water separation for fluids accumulated from drainage bore patterns 32.

Each down-hole pump 40 is connected to surface 22 via a respective tubing string 42 and may be powered by sucker rods extending down through wells 14 of tubing strings 42. Sucker rods are reciprocated by a suitable surface mounted apparatus, such as a powered walking beam 46 to operate each down-hole pump 40. Each down-hole pump 40 is used to remove water and entrained coal finds from subterranean zone 24 via drainage bore patterns 32. In the case of a coal seam, once the water is removed to the surface, it may be treated for separation of methane which may be dissolved in the water and for removal of entrained finds. After sufficient water has been removed from subterranean zone 24, pure coal seam gas may be allowed to flow to surface 22 through the annulus of wells 14 around tubing strings 42 and removed via piping attached to a well head apparatus. At surface 22, the methane is treated, compressed and pumped through a pipeline for use as fuel in a conventional manner. Each down-hole pump 40 may be operated continuously or as needed to remove water drained from subterranean zone 24 into cavities 18.

Figure 3:
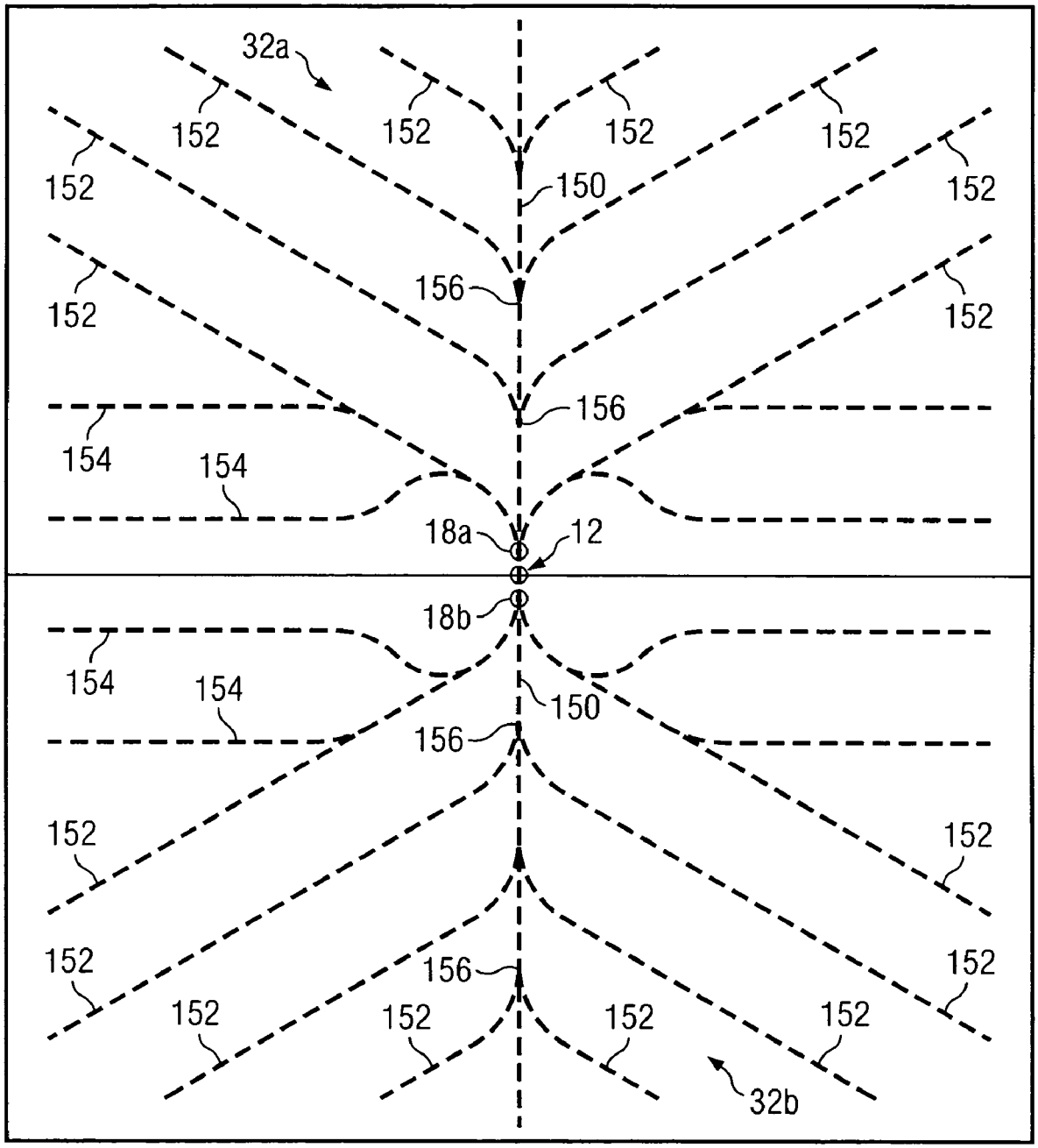
FIG. 3 illustrates one embodiment of subterranean drainage patterns of the well system of FIG. 2.

FIG. 3 illustrates one embodiment of the subterranean patterns 32*a* and 32*b* for accessing subterranean zone 24 or other subterranean zone. The patterns 32*a* and 32*b* may be used to remove or inject water, gas or other fluids. The subterranean patterns 32*a* and 32*b* each comprise a multilateral pattern that has a main bore with generally symmetrically arranged and appropriately spaced laterals extending from each side of the main bore. As used herein, the term each means every one of at least a subset of the identified items. It will be understood that other suitable multi-branching or other patterns including or connected to a surface production bore may be used. For example, the patterns 32*a* and 32*b* may each comprise a single main bore. Referring to FIG. 3, patterns 32*a* and 32*b* each include a main bore 150 extending from a corresponding cavity 18*a* or 18*b*, respectively, or intersecting wells 14 or 16 along a center of a coverage area to a distal end of the coverage area. The main bore 150 includes one or more primary lateral bores 152 extending from the main bore 150 to at least approximately to the periphery of the coverage area. The primary lateral bores 152 may extend from opposite sides of the main bore 150. The primary lateral bores 152 may mirror each other on opposite sides of the main bore 150 or may be offset from each other along the main bore 150. Each of the primary lateral bores 152 may include a radiused curving portion extending from the main bore 150 and a straight portion formed after the curved portion has reached a desired orientation. For uniform coverage, the primary lateral bores 152 may be substantially evenly spaced on each side of the main bore 150 and extend from the main bore 150 at an angle of approximately forty-five degrees. The primary lateral bores 152 may be shortened in length based on progression away from the corresponding cavity 18*a* or 18*b*. Accordingly, the distance between the cavity or intersecting well bore and the distal end of each primary lateral bore 152 through the pattern may be substantially equally for each primary lateral 152.

One or more secondary lateral bores 152 may be formed off one or more of the primary lateral bores 152. In a particular embodiment, a set of secondary laterals 154 may be formed off the primary lateral bores 152 of each pattern 32*a* and 32*b* closest to the corresponding cavity 18*a* and 18*b*. The secondary laterals 154 may provide coverage in the area between the primary lateral bores 152 of patterns 32*a* and 32*b*. In a particular embodiment, a first primary lateral 154 may include a reversed radius section to provide more uniform coverage of subterranean zone 24.

The subterranean patterns 32*a* and 32*b* with their central bore and generally symmetrically arranged and appropriately spaced auxiliary bores on each side may provide a substantial uniform pattern for draining fluids from subterranean zone 24 or other subterranean zone. The number and spacing of the lateral bores may be adjusted depending on the absolute, relative and/or effective permeability of the coal seam and the size of the area covered by the pattern. The area covered by the pattern may be the area drained by the pattern, the area of a spacing unit that the pattern is designed to drain, the area within the distal points or periphery of the pattern and/or the area within the periphery of the pattern as well as surrounding area out to a periphery intermediate to adjacent or neighboring patterns. The coverage area may also include the depth, or thickness of the coal seam or, for thick coal seams, a portion of the thickness of the seam. Thus, the pattern may include upward or downward extending branches in addition to horizontal branches. The coverage area may be a square, other quadrilateral, or other polygon, circular, oval or other ellipsoid or grid area and may be nested with other patterns of the same or similar type. It will be understood that other suitable drainage bore patterns may be used.

As previously described, the well bore 150 and the lateral bores 152 and 154 of patterns 32*a* and 32*b* are formed by drilling through the corresponding cavity 18*a* or 18*b* using the drill string 26 in appropriate drilling apparatus. During this operation, gamma ray logging tools and conventional MWD technologies may be employed to control the direction and orientation of drill bit 28 so as to retain the drainage bore pattern within the confines of subterranean zone 24 and to maintain proper spacing and orientation of wells 150 and 152. In a particular embodiment, the main well bore 150 of each pattern 32*a* and 32*b* is drilled with an incline at each of the plurality of lateral branch points 156. After the main well bore 150 is complete, the drill string 26 is backed up to each successive lateral point 156 from which a primary lateral bore 152 is drilled on each side of the well bore 150. The secondary laterals 154 may be similarly formed. It will be understood that the subterranean patterns 32*a* and 32*b* may be otherwise suitably formed. Furthermore, as described above, a pattern (as illustrated in FIG. 3) or otherwise may be formed off of portion 38 of articulated well 16 (which would function as well bore 150) such that cavities 18 are located at the end of portion 38/well bore 150.

Figure 4:
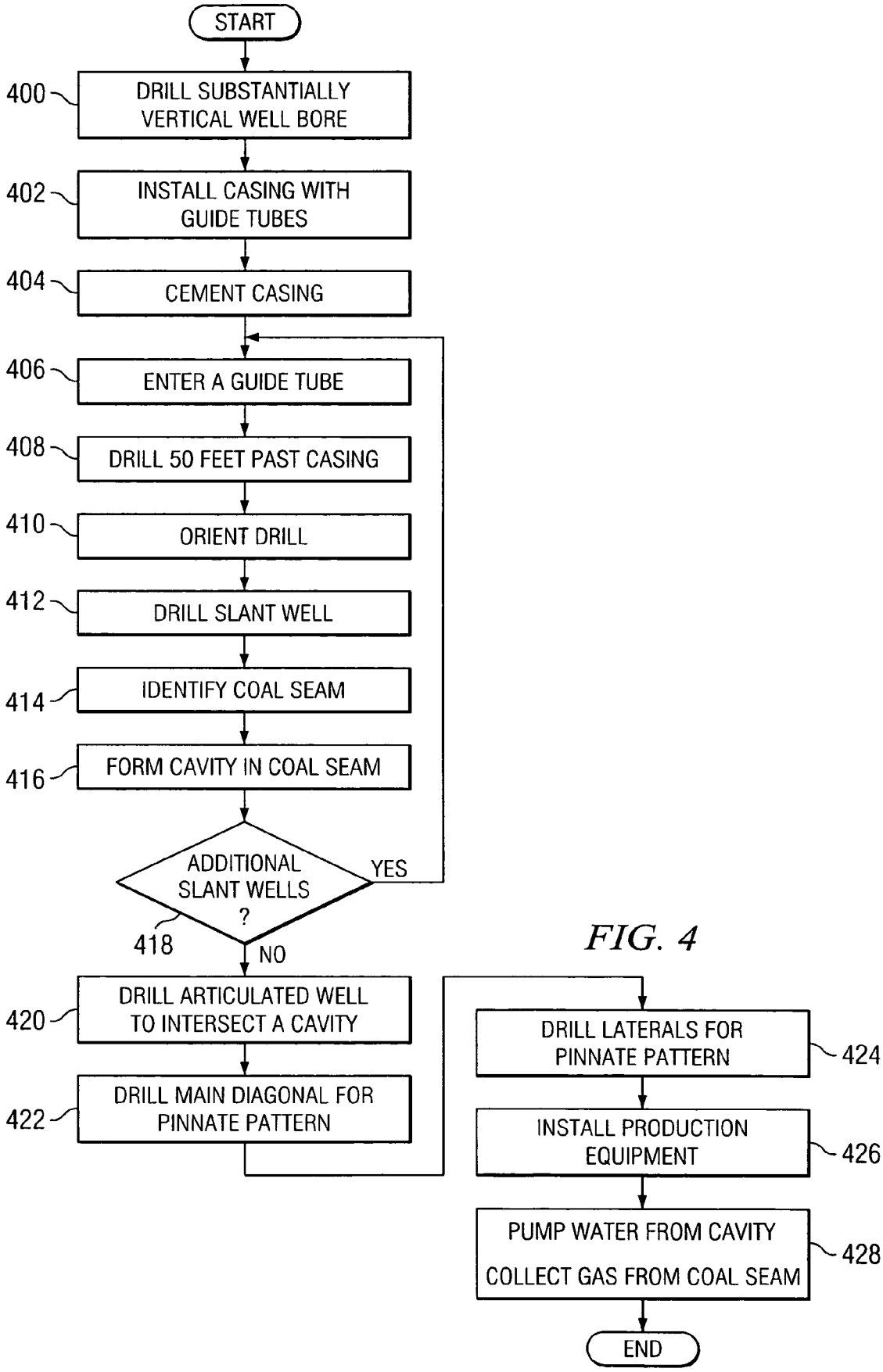
FIG. 4 illustrates an example method for producing fluids from a subterranean zone using the well bore system of FIG. 1.

FIG. 4 is a flow diagram illustrating a method for preparing subterranean zone 24 for mining operations in accordance with particular embodiments of the present invention. The example method begins at step 400 in which entry well 12 is drilled substantially vertically from the surface. At step 402, a casing with guide tubes is installed into the entry well 12. At step 404, the casing is cemented in place inside entry well 12.

At step 406, drill string 26 is inserted through entry well 12 and one of the guide tubes in the guide tube bundle. At step 408, drill string 26 is used to drill approximately fifty feet past the casing. At step 410, the drill is oriented to the desired angle of the drainage well 14 and, at step 412, drainage well bore 14 is drilled down into and through target subterranean zone 24.

At step 414, down-hole logging equipment may be utilized to identify the location of the subterranean zone 24. At step 416, cavity 18*a* is formed in first drainage well 14 at the location of subterranean zone 24. As previously discussed, cavity 18 may be formed by underreaming and other conventional techniques. At decisional step 418, if additional drainage wells are to be drilled, the method returns to step 406. If no additional drainage wells 14 are to be drilled, then the method proceeds to step 420.

At step 420, articulated well 16 is drilled to intersect cavity 18. At step 422, drainage bore pattern 32 is drilled into subterranean zone 24. At step 424, production equipment is installed into drainage wells 14 and at step 426 the process ends with the production of fluids (such as water and gas) from the subterranean zone 24.

Although the steps have been described in a certain order, it will be understood that they may be performed in any other appropriate order. Furthermore, one or more steps may be omitted, or additional steps performed, as appropriate.

Figure 5A:
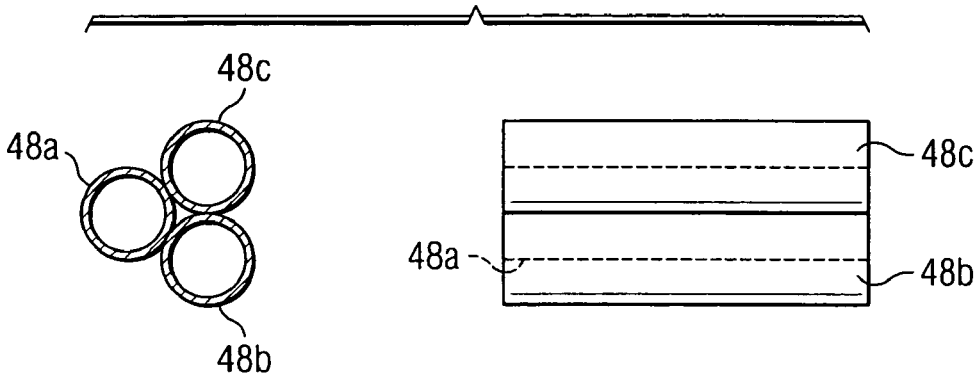
FIG. 5A illustrates construction of an example guide tube bundle for insertion into entry well of FIG. 1.

FIG. 5A illustrates formation of a casing with associated guide tube bundle as described in step 402 of FIG. 4. Three guide tubes 48 are shown in side view and end view. The guide tubes 48 are arranged so that they are parallel to one another. In the illustrated embodiment, guide tubes 48 are 9⅝" joint casings. It will be understood that other suitable materials may be employed. As an example, guide tubes 48*a* and 48*b* serve as the tubes through which drainage wells 14*a* and 14*b* are drilled, respectively. In this example, guide tube 48*c* serves as the tube through which both articulated wells 16*a* and 16*b* are drilled. It will be understood that other suitable arrangements may be employed. In another embodiment, guide tubes 48 may be attached to a casing collar such that the guide tubes 48 and casing collar make up the guide tube bundle.

Figure 5B:
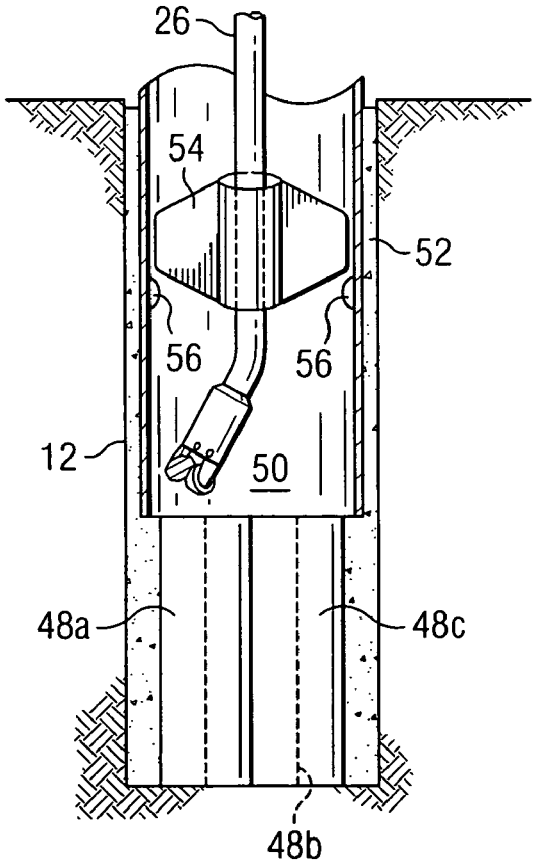
FIG. 5B illustrates an example entry well with an installed guide tube bundle.

FIG. 5B illustrates entry well 12 with guide tubes 48 and a casing collar 50 cemented in entry well 12. Entry well 12 is formed from the surface 22 to a target depth (in particular embodiments, approximately three hundred feet). In a particular embodiment, entry well 12 has a diameter of approximately twenty-four inches. Forming entry well 12 corresponds with step 400 of FIG. 4. Guide tubes 48 are shown attached to a casing collar 50. Casing collar 50 may be any casing suitable for use in down-hole operations. Inserting casing collar 50 and guide tubes 48 into entry well 12 corresponds with step 402 of FIG. 4.

Corresponding with step 404 of FIG. 4, a cement retainer 52 is poured or otherwise installed around the casing inside entry well 12. The cement casing may be any mixture or substance otherwise suitable to maintain casing 50 in the desired position with respect to entry well 12.

In operation, drill string 26 is positioned to enter one of the guide tubes 48. In order to keep drill string 26 relatively centered in casing 50, a stabilizer 54 may be employed. Stabilizer 54 may be a ring and fin type stabilizer or any other stabilizer suitable to keep drill string 26 relatively centered. To keep stabilizer 54 at a desired depth in well bore 12, stop ring 56 may be employed. Stop ring 56 may be constructed of rubber or metal or any other foreign down-hole environment material suitable. Drill string 26 may be inserted randomly into any of a plurality of guide tubes 48, or drill string 26 may be directed into a selected guide tube 48*a*. This corresponds to step 406 of FIG. 4.

Although the present invention has been described with several embodiments, various changes and modifications may be suggested to one skilled in the art. It is intended that the present invention encompass such changes and modifications as fall within the scope of the appended claims.

What is claimed is:

1. A method for accessing a subterranean zone, comprising:

forming an entry well from the surface, the entry well having a substantially vertical portion;

forming a drainage well extending from the entry well to a subterranean zone, the drainage well comprising at least one slanted portion;

forming an articulated well extending from the entry well to the subterranean zone, the articulated well extending from the entry well to intersect the drainage well at a junction proximate the subterranean zone;

forming a drainage pattern through the articulated well, the drainage pattern coupled to the junction and operable to conduct fluid from the subterranean zone to the junction; and forming a second drainage well from the entry well to the subterranean zone, the second drainage well comprising at least one slanted portion;

forming a second articulated well from the entry well to the subterranean zone, the second articulated well intersecting the second drainage well at a second junction proximate the subterranean zone.

2. The method of claim 1, further comprising forming an enlarged cavity in the drainage well proximate the subterranean zone.

3. The method of claim 1, further comprising inserting a guide tube bundle into the entry well and forming one or more of the drainage well or the articulated well using the guide tube bundle.

4. The method of claim 1, wherein forming the drainage pattern comprises forming a main well bore and a plurality of lateral well bores extending from the main well bore.

5. The method of claim 4, wherein the lateral wells are configured to drain an area of the subterranean zone of at least 640 acres.

6. The method of claim 1, further comprising removing resources from the subterranean zone through the drainage pattern to the surface.

7. A method for accessing a subterranean zone, comprising:

forming an entry well from the surface, the entry well having a substantially vertical portion;

forming a drainage well extending from the entry well to a subterranean zone, the drainage well comprising at least one slanted portion;

forming an articulated well extending from the entry well to the subterranean zone, the articulated well extending from the entry well to intersect the drainage well at a junction proximate the subterranean zone;

forming a drainage pattern through the articulated well, the drainage pattern coupled to the junction and operable to conduct fluid from the subterranean zone to the junction;

forming a second drainage well from the entry well to the subterranean zone, the second drainage well comprising at least one slanted portion; and forming a second articulated well from the entry well to the subterranean zone, the second articulated well intersecting the second drainage well at a second junction proximate the subterranean zone, wherein the drainage wells are radially spaced approximately equally around the entry well.

8. A method for accessing a subterranean zone, comprising:

forming an entry well from the surface, the entry well having a substantially vertical portion;

forming a drainage well extending from the entry well to a subterranean zone, the drainage well comprising at least one slanted portion;

forming an articulated well extending from the entry well to the subterranean zone, the articulated well extending from the entry well to intersect the drainage well at a junction proximate the subterranean zone;

forming a drainage pattern through the articulated well, the drainage pattern coupled to the junction and operable to conduct fluid from the subterranean zone to the junction;

forming a second drainage well from the entry well to the subterranean zone, the second drainage well comprising at least one slanted portion; and forming a second articulated well from the entry well to the subterranean zone, the second articulated well intersecting the second drainage well at a second junction proximate the subterranean zone, wherein the articulated wells are radially spaced approximately equally around the entry well.

9. A method for accessing a subterranean zone, comprising:

forming an entry well from the surface, the entry well having a substantially vertical portion;

forming a drainage well extending from the entry well to a subterranean zone, the drainage well comprising at least one slanted portion;

forming an articulated well extending from the entry well to the subterranean zone, the articulated well extending from the entry well to intersect the drainage well at a junction proximate the subterranean zone;

forming a drainage pattern through the articulated well, the drainage pattern coupled to the junction and operable to conduct fluid from the subterranean zone to the junction;

forming a second drainage well from the entry well to the subterranean zone, the second drainage well comprising at least one slated portion;

forming a second articulated well from the entry well to the subterranean zone, the second articulated well intersecting the second drainage well at a second junction proximate the subterranean zone;

forming a third drainage well from the entry well to the subterranean zone, the third drainage well comprising at least one slanted portion;

forming a third articulated well from the entry well to the subterranean zone, the third articulated well intersecting the third drainage well at a third junction proximate the subterranean zone.

10. A system for accessing a subterranean zone from an entry well, comprising:

an entry well extending from the surface, the entry well having a substantially vertical portion;

a drainage well extending from the entry well to a subterranean zone, the drainage well comprising at least one slanted portion;

an articulated well extending from the entry well to the subterranean zone, the articulated well extending from the entry well to intersect the drainage well at a junction proximate the subterranean zone;

an inlet of a downhole pumping unit residing in the junction;

a drainage pattern coupled to the junction and operable to conduct fluid from the subterranean zone to the junction;

a second drainage well extending from the entry well to the subterranean zone, the second drainage well comprising at least one slanted portion; and a second articulated well intersecting the drainage well at a second junction proximate the subterranean zone.

11. The system of claim 10, further comprising an enlarged cavity formed in the drainage well proximate the subterranean zone.

12. The system of claim 10, further comprising a guide tube bundle inserted into the entry well for forming one or more of the drainage well or the articulated well.

13. The system of claim 10, wherein the drainage pattern comprises a main well bore and a plurality of lateral well bores extending from the main well bore.

14. The system of claim 13, wherein the lateral wells are configured to drain an area of the subterranean zone of at least 640 acres.

15. A system for accessing a subterranean zone from an entry well, comprising:

an entry well extending from the surface, the entry well having a substantially vertical portion;

a drainage well extending from the entry well to a subterranean zone, the drainage well comprising at least one slanted portion;

an articulated well extending from the entry well to the subterranean zone, the articulated well extending from the entry well to intersect the drainage well at a junction proximate the subterranean zone;

an inlet of a downhole pumping unit residing in the junction; and a drainage pattern coupled to the junction and operable to conduct fluid from the subterranean zone to the junction;

a second drainage well extending from the entry well to the subterranean zone, the second drainage well comprising at least one slanted portion; and a second articulated well intersecting the drainage well at a second junction proximate the subterranean zone, wherein the drainage wells are radially spaced approximately equally around the entry well.

16. A system for accessing a subterranean zone from an entry well, comprising:

an entry well extending from the surface, the entry well having a substantially vertical portion;

a drainage well extending from the entry well to a subterranean zone, the drainage well comprising at least one slanted portion;

an articulated well extending from the entry well to the subterranean zone, the articulated well extending from the entry well to intersect the drainage well at a junction proximate the subterranean zone;

an inlet of a downhole pumping unit residing in the junction; and a drainage pattern coupled to the junction and operable to conduct fluid from the subterranean zone to the junction;

a second drainage well extending from the entry well to the subterranean zone, the second drainage well comprising at least one slanted portion; and a second articulated well intersecting the drainage well at a second junction proximate the subterranean zone, wherein the articulated wells are radially spaced approximately equally around the entry well.

17. A system for accessing a subterranean zone from an entry well, comprising:

an entry well extending from the surface, the entry well having a substantially vertical portion;

a drainage well extending from the entry well to a subterranean zone, the drainage well comprising at least one slanted portion;

an articulated well extending from the entry well to the subterranean zone, the articulated well extending from the entry well to intersect the drainage well at a junction proximate the subterranean zone;

an inlet of a downhole pumping unit residing in the junction; and a drainage pattern coupled to the junction and operable to conduct fluid from the subterranean zone to the junction;

a second drainage well extending from the entry well to the subterranean zone, the second drainage well comprising at least one slanted portion;

a second articulated well intersecting the drainage well at a second junction proximate the subterranean zone;

a third drainage well from the entry well to the subterranean zone, the third drainage well comprising at least one slanted portion;

a third articulated well from the entry well to the subterranean zone, the third articulated well intersecting the third drainage well at a third junction proximate the subterranean zone.

18. A method for accessing a subterranean zone from an entry well, comprising:

forming an entry well from the surface, the entry well having a substantially vertical portion;

forming a drainage well extending from the entry well to a subterranean zone, the drainage well comprising at least one slanted portion;

forming an enlarged cavity in the drainage well proximate the subterranean zone;

forming an articulated well extending from the entry well to the subterranean zone, the articulated well extending from the entry well to intersect the enlarged cavity of the drainage well at a junction proximate the subterranean zone;

forming a drainage pattern through the articulated well, the drainage pattern coupled to the junction and operable to conduct fluid from the subterranean zone to the junction, the drainage pattern extending from the junction into the target zone and comprises a set of lateral wells extending from a main well bore;

forming a second drainage well extending from the entry well to a subterranean zone, the drainage well comprising at least one slanted portion; and forming a second articulated well extending from the entry well to the subterranean zone, the articulated well extending from the entry well to intersect the enlarged cavity of the drainage well at a junction proximate the subterranean zone.

19. A method for accessing a subterranean zone, comprising:

forming an entry well from the surface;

forming a drainage well extending from the entry well to a subterranean zone;

forming an articulated well extending from the entry well to the subterranean zone, the articulated well extending from the entry well to intersect the drainage well at a junction proximate the subterranean zone;

forming a drainage bore through the articulated well, the drainage bore coupled to the junction and operable to conduct fluid from the subterranean zone to the junction;

forming a second drainage well from the entry well to the subterranean zone; and forming a second articulated well from the entry well to the subterranean zone, the second articulated well intersecting the second drainage well at a second junction proximate the subterranean zone.

20. The method of claim 19, further comprising forming an enlarged cavity in the drainage well proximate the subterranean zone.

21. The method of claim 19, further comprising removing resources from the subterranean zone through the drainage pattern to the surface.

22. A method for accessing a subterranean zone, comprising:

forming an entry well from the surface;

forming a drainage well extending from the entry well to a subterranean zone;

forming an articulated well extending from the entry well to the subterranean zone, the articulated well extending from the entry well to intersect the drainage well at a junction proximate the subterranean zone;

forming a drainage bore through the articulated well, the drainage bore coupled to the junction and operable to conduct fluid from the subterranean zone to the junction;

forming a second drainage well from the entry well to the subterranean zone; and forming a second articulated well from the entry well to the subterranean zone, the second articulated well intersecting the second drainage well at a second junction proximate the subterranean zone, wherein the drainage wells are radially spaced approximately equally around the entry well.

* * * * *

UNITED STATES PATENT AND TRADEMARK OFFICE

CERTIFICATE OF CORRECTION

PATENT NO. : 7,222,670 B2
APPLICATION NO. : 10/788694
DATED : May 29, 2007
INVENTOR(S) : Joseph A. Zupanick It is certified that error appears in the above-identified patent and that said Letters Patent is hereby corrected as shown below:

On the Title Page Item [56] OTHER PUBLICATIONS, page 4, column 2, line 30, delete "Abu Chabi," and insert -- Abu Dhabi, --.

On the Title Page Item [56] OTHER PUBLICATIONS, page 4, column 2, line 55, delete "Abu Chabi," and insert -- Abu Dhabi, --.

On the Title Page Item [56] OTHER PUBLICATIONS, page 5, column 2, line 55, before "Pittsburg Research Center" insert -- Pittsburg, PA, --.

On the Title Page Item [56] OTHER PUBLICATIONS, page 6, column 1, line 24, delete "Acquistion" and insert -- Acquisition --.

On the Title Page Item [56] OTHER PUBLICATIONS, page 6, column 2, line 2, after "Advance" delete "in" and insert -- of --.

On the Title Page Item [56] OTHER PUBLICATIONS, page 6, column 2, line 42, delete "Impace" and insert -- impact --.

On the Title Page Item [56] OTHER PUBLICATIONS, page "Harris Nesbit Corp.," and insert -- Harris Nesbitt Corp., --.

On the Title Page Item [56] OTHER PUBLICATIONS, page 7, column 1, line 30, delete "Performance" and insert -- Performances --.

On the Title Page Item [56] OTHER PUBLICATIONS, page 7, column 2, line 18, delete "Candian" and insert -- Canadian --.

On the Title Page Item [56] OTHER PUBLICATIONS, page 7, column 2, line 19, delete "1002)," and insert -- 102), --.

On the Title Page Item [56] OTHER PUBLICATIONS, page 7, column 2, line 24, delete "Selsmic" and insert -- Seismic --.

On the Title Page Item [56] OTHER PUBLICATIONS, page 8, column 1, line 4, after "Zupanick," insert -- et al., --.

UNITED STATES PATENT AND TRADEMARK OFFICE

CERTIFICATE OF CORRECTION

PATENT NO. : 7,222,670 B2
APPLICATION NO. : 10/788694
DATED : May 29, 2007
INVENTOR(S) : Joseph A. Zupanick It is certified that error appears in the above-identified patent and that said Letters Patent is hereby corrected as shown below:

On the Title Page Item [56] OTHER PUBLICATIONS, page 8, column 1, line 7, after "Zupanick," insert -- et al., --.

On the Title Page Item [56] OTHER PUBLICATIONS, page 8, column 1, line 18, delete "Contolling" and insert -- Controlling --.

On the Title Page Item [56] OTHER PUBLICATIONS, page 8, column 1, line 38, delete "Subterranen" and insert -- Subterranean --.

On the Title Page Item [56] OTHER PUBLICATIONS, page 8, column 2, line 32, delete "Copywrite Page," and insert -- Copyright Page --.

On the Title Page Item [56] OTHER PUBLICATIONS, page 8, column 2, line 37, delete "Wollongoon," and insert -- Wollongong, --.

On the Title Page Item [56] OTHER PUBLICATIONS, page 9, column 2, line 32, delete "Applachian" and insert -- Appalachian --.

On the Title Page Item [56] OTHER PUBLICATIONS, page 9, column 2, line 55, delete "Areally" and insert -- A really --.

On the Title Page Item [56] OTHER PUBLICATIONS, page 10, column 1, line 4, delete "Werngren," and insert -- Wemgren, --.

On the Title Page Item [56] OTHER PUBLICATIONS, page 10, column 1, line 24, delete "2002 pages." and insert -- 202 pages. --.

On the Title Page Item [56] OTHER PUBLICATIONS, page 11, column 2, line 69, delete "Applachian" and insert -- Appalachian --.

On the Title Page Item [56] OTHER PUBLICATIONS, page 12, column 1, line 4, delete "Walters's," and insert -- Walter's, --.

UNITED STATES PATENT AND TRADEMARK OFFICE

CERTIFICATE OF CORRECTION

PATENT NO. : 7,222,670 B2
APPLICATION NO. : 10/788694
DATED : May 29, 2007
INVENTOR(S) : Joseph A. Zupanick It is certified that error appears in the above-identified patent and that said Letters Patent is hereby corrected as shown below:

Col. 9, line 14, in Claim 9, delete "slated" and insert -- slanted --.

Signed and Sealed this

Fifteenth Day of December, 2009

David J. Kappos

David J. Kappos
*Director of the United States Patent and Trademark Office*